US011817654B2

(12) United States Patent
Little et al.

(10) Patent No.: US 11,817,654 B2
(45) Date of Patent: Nov. 14, 2023

(54) ELECTRICAL DEVICE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Terrance F. Little, Fullerton, CA (US); Patrick R. Casher, North Aurora, IL (US); An-Jen Yang, Irvine, CA (US); Chih-Hsien Chou, San Jose, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 308 days.

(21) Appl. No.: 17/369,937

(22) Filed: Jul. 7, 2021

(65) Prior Publication Data

US 2022/0021158 A1 Jan. 20, 2022

Related U.S. Application Data

(60) Provisional application No. 63/053,611, filed on Jul. 18, 2020.

(51) Int. Cl.

| | |
|---|---|
| ***H01R 4/66*** | (2006.01) |
| ***H01R 13/6471*** | (2011.01) |
| ***H01R 13/405*** | (2006.01) |
| ***H01R 12/79*** | (2011.01) |
| ***H01R 13/518*** | (2006.01) |

(52) U.S. Cl.
CPC ..... *H01R 13/6471* (2013.01); *H01R 12/79* (2013.01); *H01R 13/405* (2013.01); *H01R 13/518* (2013.01)

(58) Field of Classification Search
CPC ..... H01R 13/6471; H01R 13/6461; H01R 13/405; H01R 13/518; H01R 12/79; H01R 12/71
USPC ..... 439/108
See application file for complete search history.

(56) References Cited

U.S. PATENT DOCUMENTS

| | | | |
|---|---|---|---|
| 8,764,460 | B2 | 7/2014 | Smink et al. |
| 8,764,464 | B2 | 7/2014 | Buck et al. |
| 9,759,879 | B1 | 9/2017 | Takai et al. |
| 9,768,557 | B2 | 9/2017 | Phillips et al. |
| 9,837,740 | B2 | 12/2017 | Liao |

(Continued)

*Primary Examiner* — Khiem M Nguyen
(74) *Attorney, Agent, or Firm* — Ming Chieh Chang

(57) ABSTRACT

A connector unit includes a contact module received within an insulative housing. The contact module includes an upper contact unit and a lower contacts unit stacked with each other. Each of the upper contact unit and the lower contact unit includes a front/outer contact part and a rear/inner contact part each including plural contacts integrally formed with plural insulative transverse bars via insert-molding. The contacts include plural differential pair signal contacts and plural grounding contacts alternately arranged with each other along a transverse direction. Plural grounding bars are attached to corresponding transverse bars, respectively, wherein each grounding bar include plural tabs mechanically and electrically connecting to the corresponding grounding contacts. Each grounding bar is equipped with a plastic attachment tie bar to cooperate with a corresponding transverse bar to sandwich the grounding bar therebetween for securement.

20 Claims, 39 Drawing Sheets

(56) References Cited

U.S. PATENT DOCUMENTS

| | | | |
|---|---|---|---|
| 10,367,308 | B2 | 7/2019 | Little et al. |
| 2019/0089106 | A1 | 3/2019 | Regnier |

ELECTRICAL DEVICE

BACKGROUND OF THE INVENTION

1. Field of the Invention

The present invention relates generally to an electrical device having a metallic cage enclosing an electrical connector assembly wherein the electrical connector assembly includes an upper connector unit and a lower connector unit each having a respective contact module equipped with grounding bars.

2. Description of Related Art

U.S. Pat. No. 8,764,460, issued on Jul. 1, 2014, discloses an electrical connector having a first row of contact pins. The first row of contact pins comprises a first grounding pin, a second grounding pin, and a first signal pin arranged between the first grounding pin and the second grounding pin. A grounding bar electrically connects the first grounding pin and the second grounding pin. The grounding bar and the grounding pin are an integral structure which will waste more materials during manufacturing.

An improved electrical device is desired.

SUMMARY OF THE INVENTION

An electrical connector assembly includes an upper connector unit and a lower connector unit in a vertical direction. Each connector unit includes a contact module received within an insulative housing. The contact module includes an upper contact unit and a lower contacts unit stacked with each other. Each of the upper contact unit and the lower contact unit includes a front/outer contact part and a rear/inner contact part each including a plurality contacts integrally formed with a plurality of insulative transverse bars via insert-molding. The contacts include a plurality of differential pair signal contacts and a plurality of grounding contacts alternately arranged with each other along a transverse direction. A plurality of grounding bars are attached to the corresponding transverse bars, respectively, wherein each grounding bars include a plurality of tabs mechanically and electrically connecting to the corresponding grounding contacts. Each grounding bar is equipped with a plastic attachment tie bars to cooperate with the corresponding transverse bar to sandwich the grounding bar therebetween for securement.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1A:
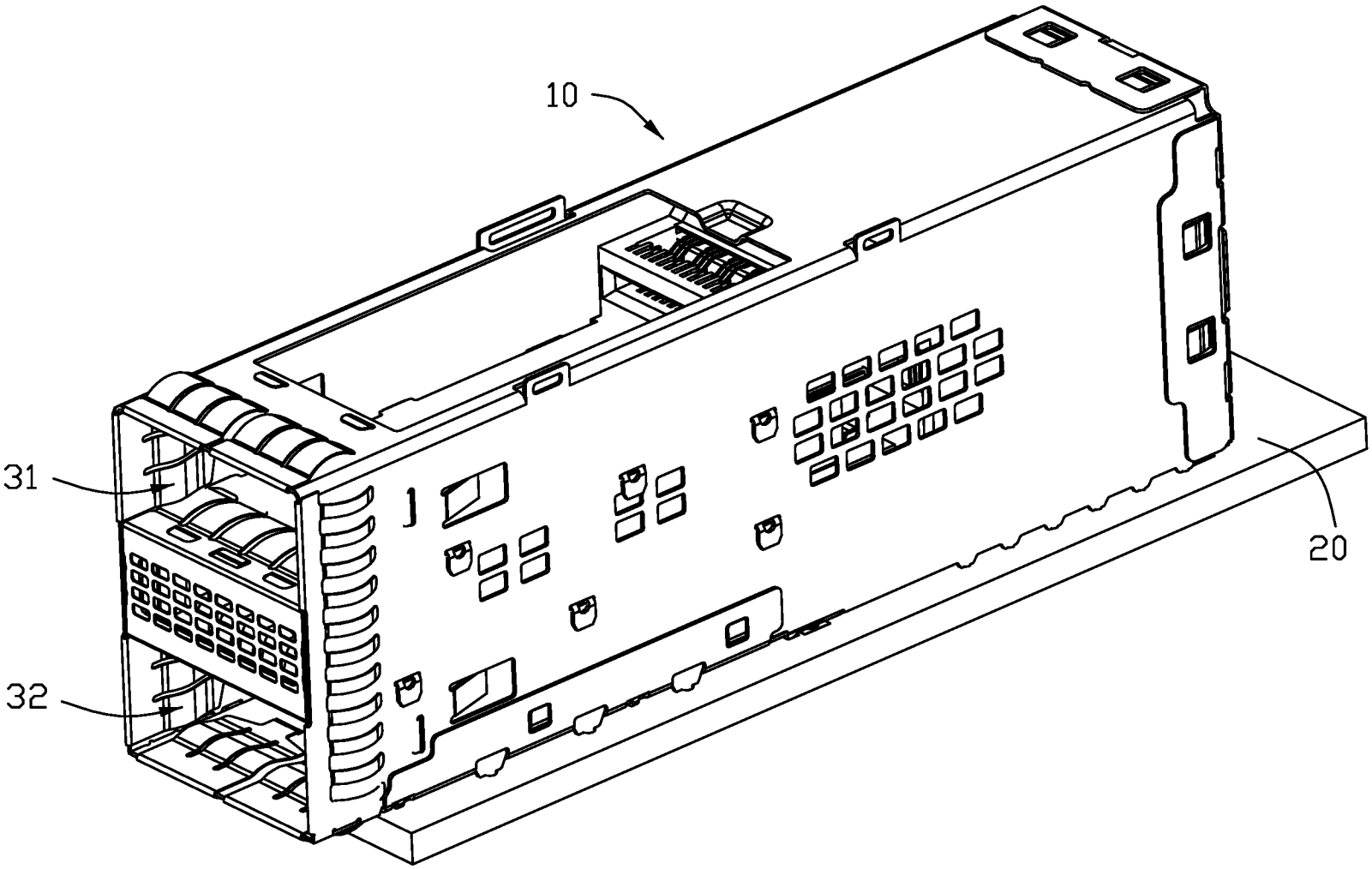
FIG. 1(A) is a perspective view of an electrical device mounted upon a printed circuit board according to the invention.
Figure 1B:
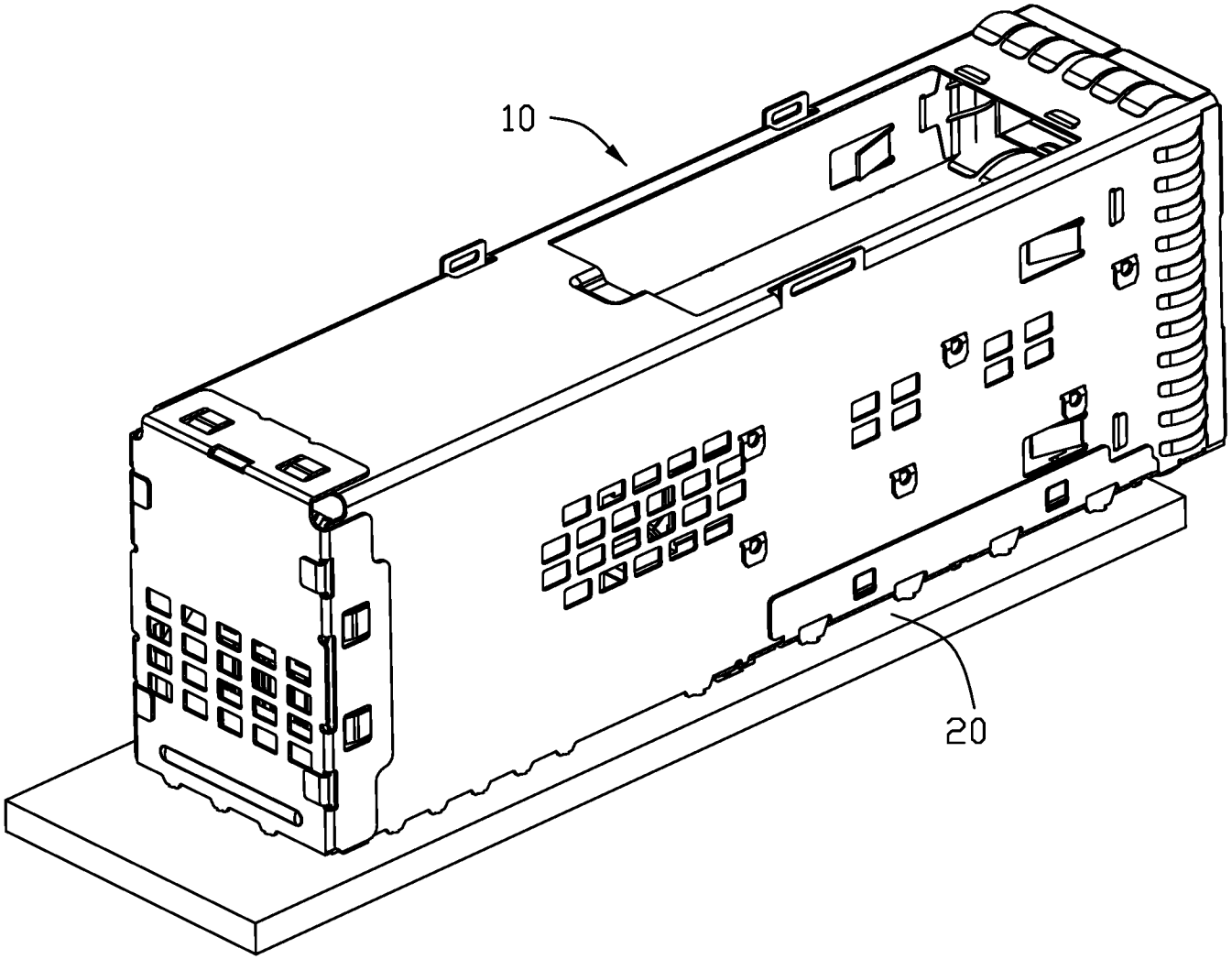
FIG. 1(B) is another perspective view of the electrical device mounted upon the printed circuit board of FIG. 1(A)
Figure 2:
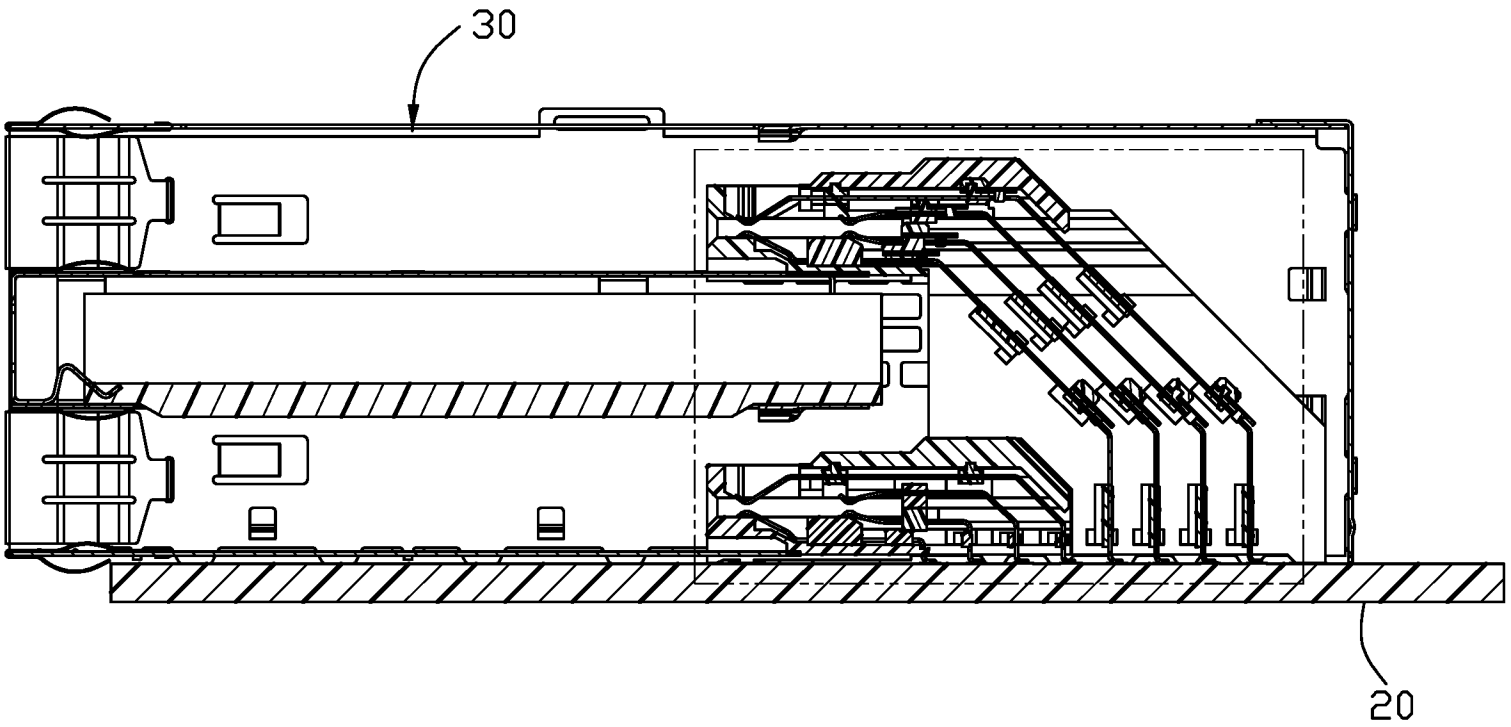
FIG. 2 is a cross-sectional view of the electrical device mounted upon the printed circuit board of FIG. 1(A)
Figure 3:
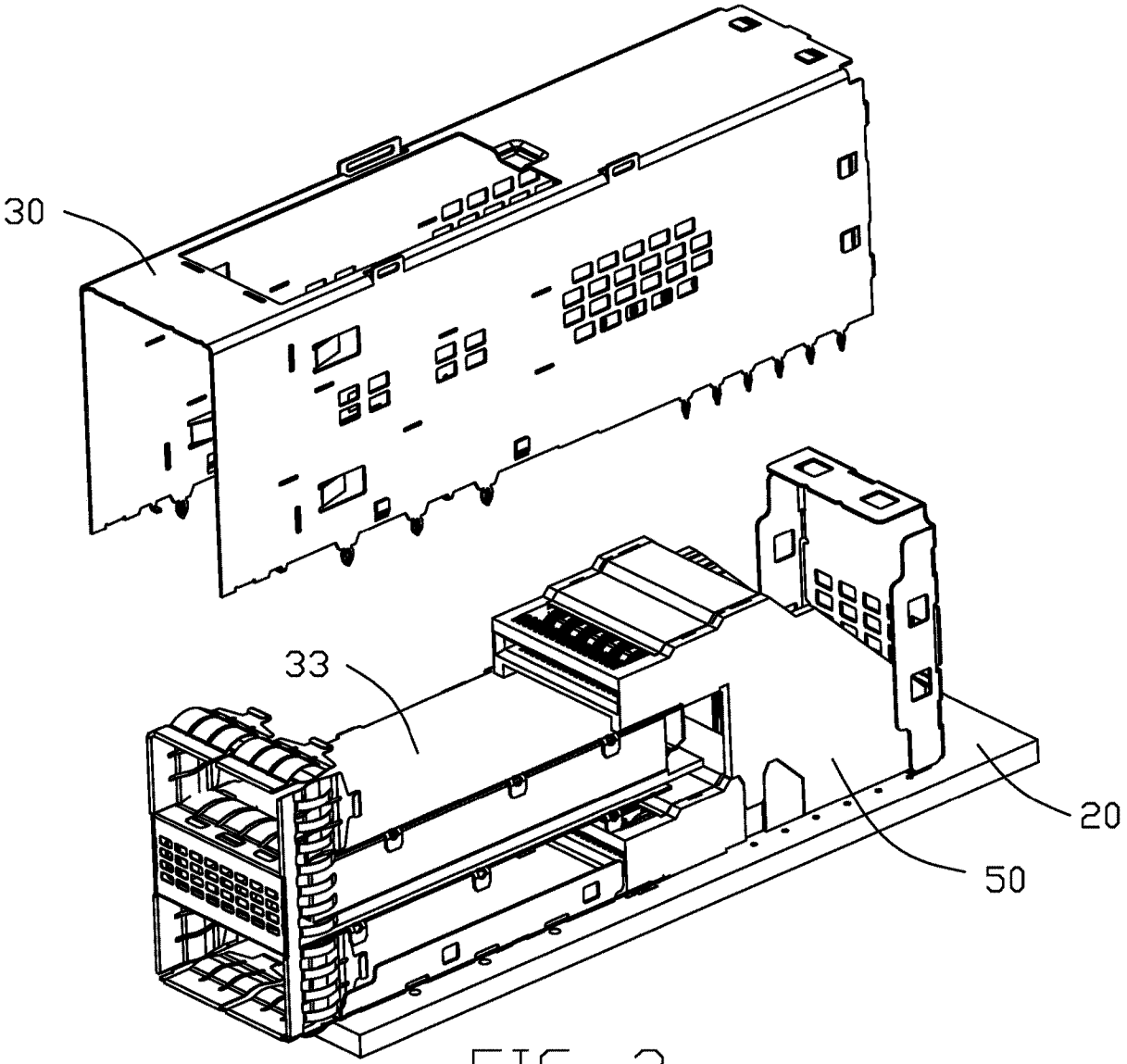
FIG. 3 is an exploded perspective view of the electrical device on the printed circuit board wherein the primary part of the metal cage is upwardly removed from the printed circuit board to expose the electrical connector assembly in the metal cage.
Figure 4A:
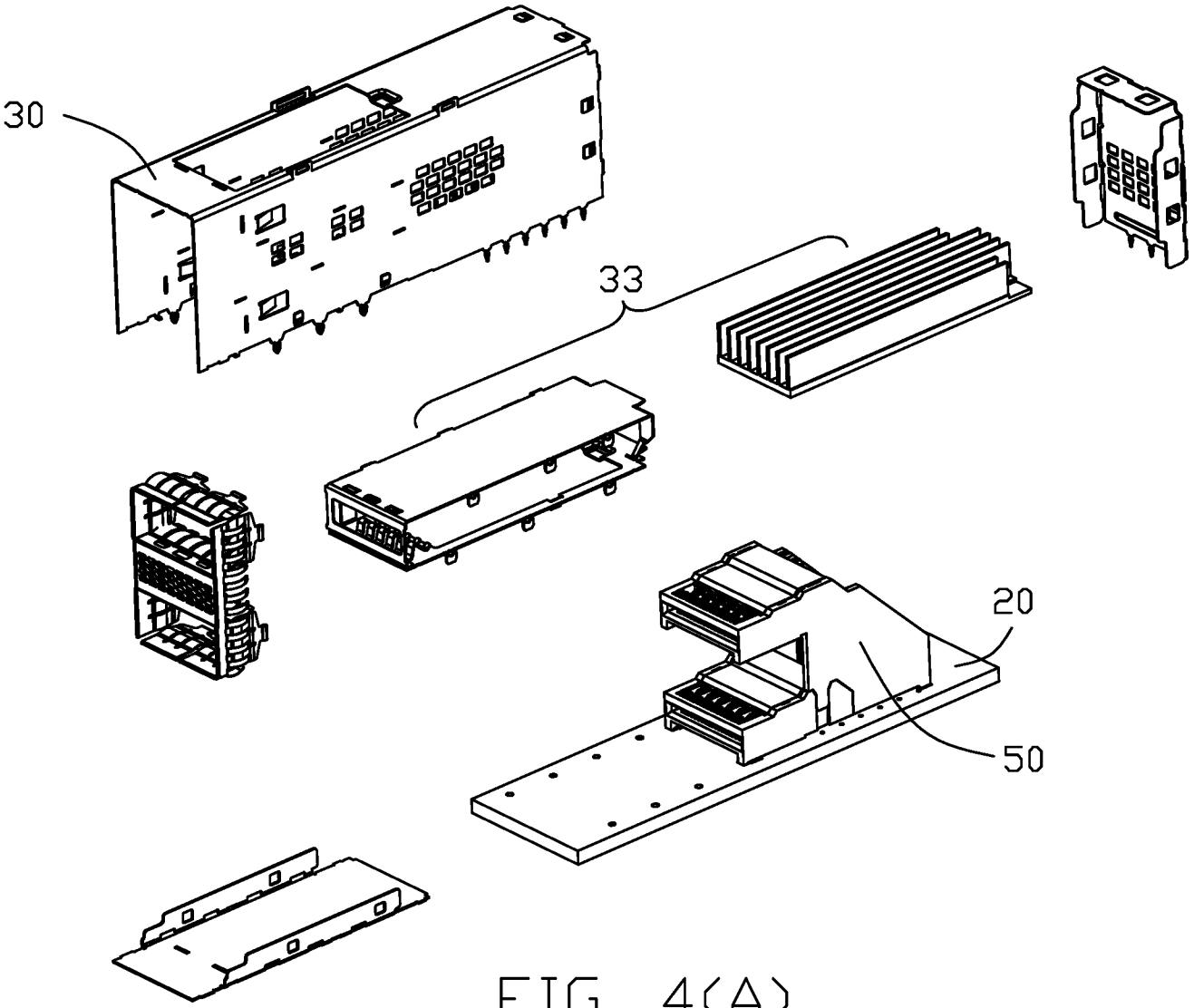
FIG. 4(A) is a further exploded perspective view of the electrical device on the printed circuit board of FIG. 3.
Figure 4B:
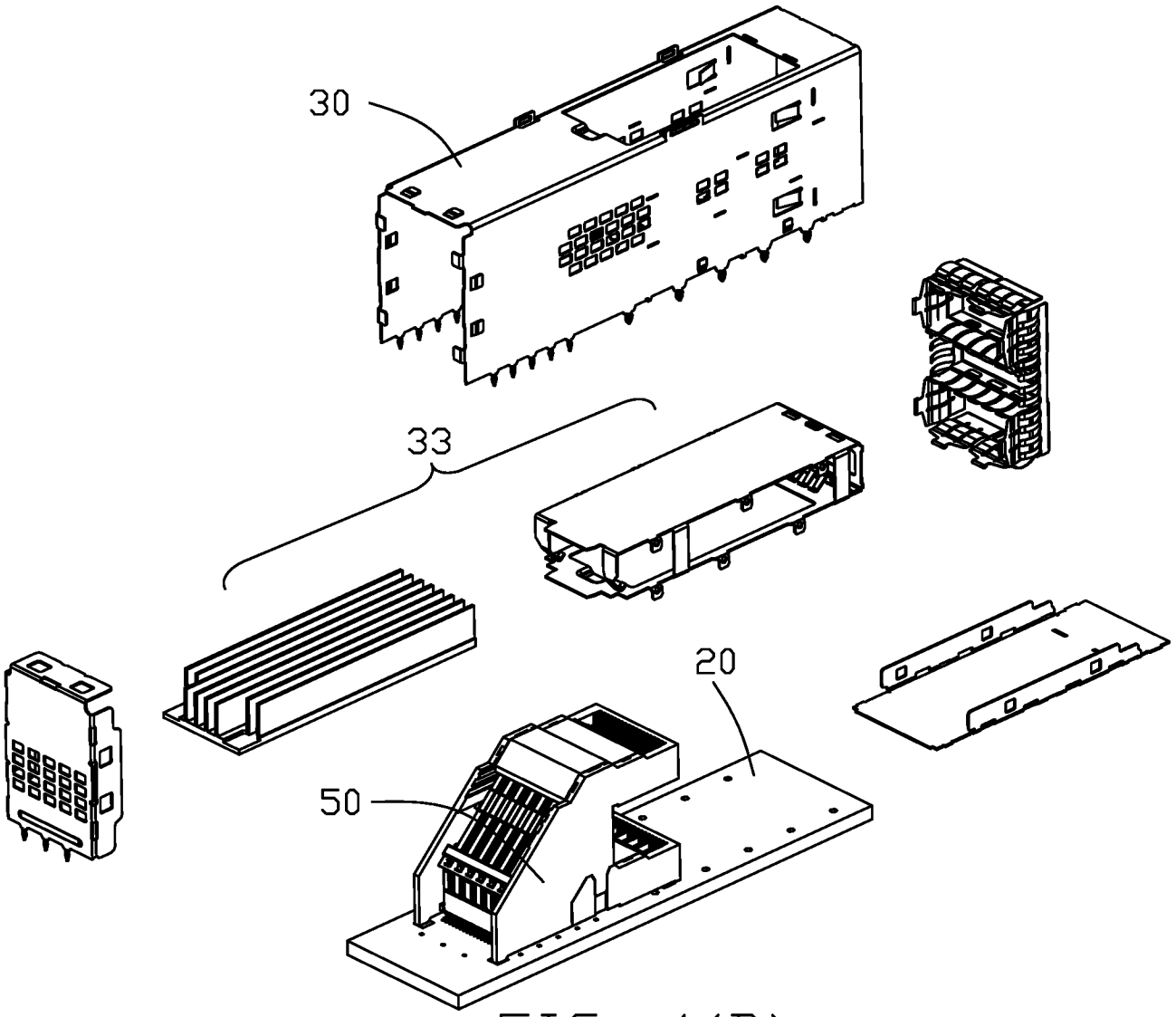
FIG. 4(B) is another exploded perspective view of the electrical device on the printed circuit board of FIG. 4(A)
Figure 5:
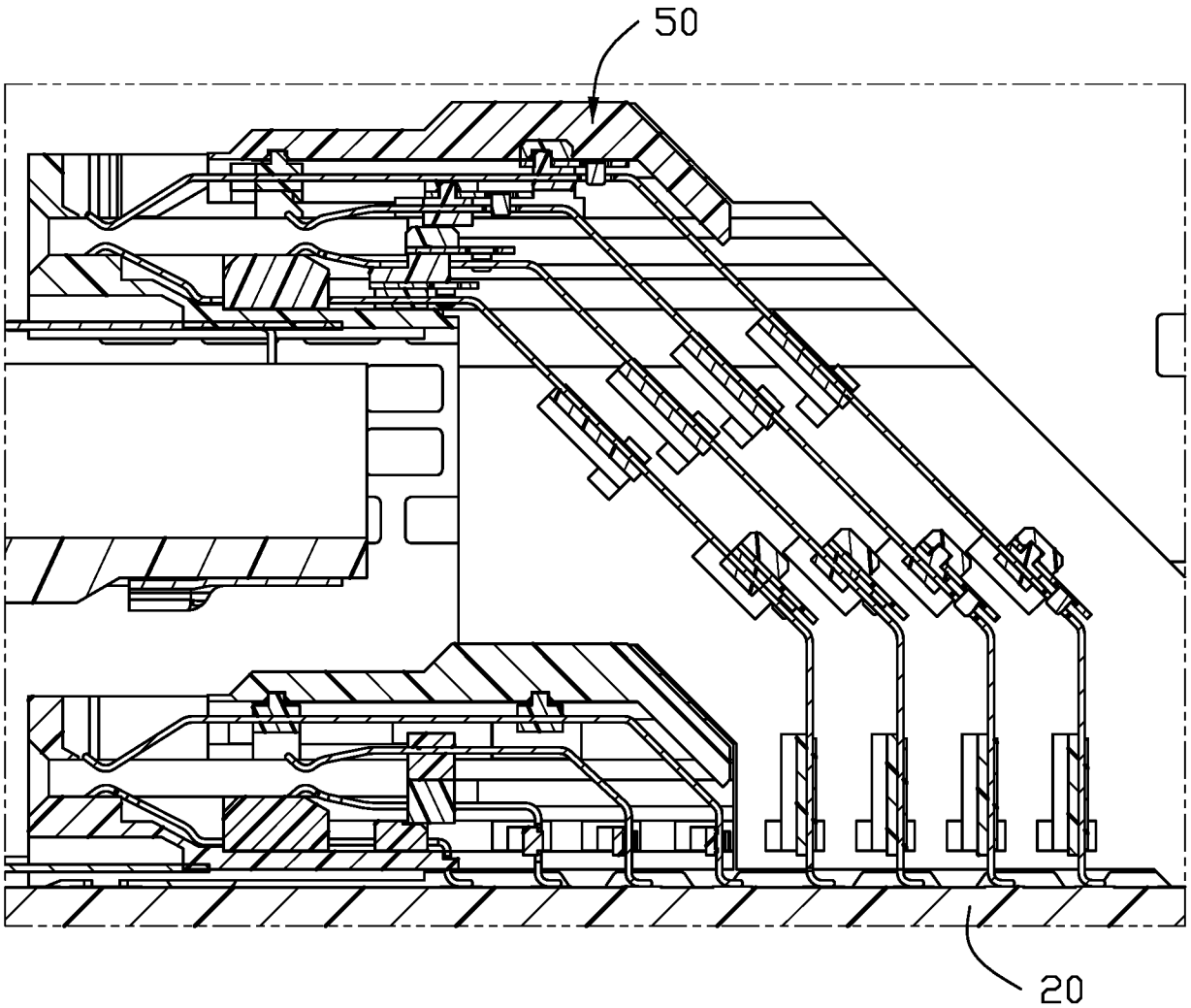
FIG. 5 is an enlarged cross-sectional view of a portion of the electrical device on the printed circuit board of FIG. 2.

Reference will now be made in detail to the embodiments of the present disclosure.

Referring to FIGS. 1-24, an electrical device 10 for mounting to a printed circuit board 20, includes a metallic cage 30 forming opposite upper mating port 31 and lower mating port 32 extending along a front-to-back direction with a heat dissipation sub-assembly 33 therebetween in a vertical direction perpendicular to the front-to-back direction. An electrical connector assembly 50 is located at a rear portion of the cage 30.

The electrical connector assembly 50 includes an upper connector unit 100 and a lower connector unit 300 respectively corresponding to the upper mating port 31 and the lower mating port 32. The upper connector unit 100 includes an insulative upper housing 110 with a pair of vertical side walls 112 extending along the front-to-back direction, a vertical front wall 114 extending along a transverse direction perpendicular to the front-to-back direction, and a horizontal partition wall 116. The front wall 114, the partition wall 116 and upper portion of the pair of side walls 112 commonly form an upper mating portion 120 for receiving a mating board of a complementary module (not shown) which is adapted to be inserted into the upper mating port 31. A horizontal mating slot 122 is formed in the upper mating portion 120. A plurality of passageways 124 are formed in the upper mating portion 120 and located by two sides of the mating slot 122.

A contact module 130 is assembled into the housing 110, and includes an upper contact unit 132 and a lower contact unit 134 disposed opposite to the upper contact unit 132. The upper contact unit 132 further includes an upper front/outer contact part 136 and an upper rear/inner contact part 138. Similarly, the lower contact unit 134 further includes a lower front/outer contact part 140 and a lower rear/inner contact part 142. The upper front/outer contact part 136 includes a plurality of differential pair signal contacts 144 and a plurality of grounding contacts 146 alternately arranged with each other along the transverse direction. At least one pair of differential pair signal contacts 144 is disposed between a pair of the grounding contacts 146. Each contact 144, 146 includes a front mating section 148, a rear mounting section 150 and a retaining section 152 therebetween. The retaining section 152 includes a horizontal section 154, a vertical section 156 and an oblique section 158 therebetween. Via insert-molding, two insulative transverse bars 160 and 162 are integrally formed upon the horizontal section 154, two insulative transverse bars 164, 166 are integrally formed upon the oblique section 158, and an insulative transverse bar 168 is integrally formed upon the vertical section 156, thus commonly forming the whole upper front/outer contact part 136 as a whole. Each of the insulative transverse bars 162, 166 includes a plurality of positioning posts 170. Two metal grounding bars 171, 172 are assembled upon and fixed by the corresponding insulative transverse bars 162, 166, respectively. Each of the metal grounding bars 171, 172 includes a base portion 175 defining a plurality of holes 174 through which the corresponding positioning posts 170 respectively extend, and a plurality of tabs 176 extending away from the base portion 175 and extending through the slits 178 formed in the corresponding grounding contacts 146 in press-fit type, a spring beam contact type or a soldering type, etc. so as to electrically connected with the grounding contacts 146, but not electrically connected with the signal contacts 144. The base portions 175 are disposed spaced apart from the signal contacts 144 to isolate with the signal contacts 144. The tabs 176 are stamped from the base portion 175. Understandably, the metal grounding bar 171, 172 may reduce the crosstalk resonance peak. Two plastic attachment tie bars 180, 182 are respectively assembled upon the corresponding grounding bars 162, 166 by press-fit, ultrasonic welding, etc., so as to cooperate with the corresponding insulative transverse bars 162, 166 to sandwich the metal grounding bar 171, 172. The plastic attachment tie bars 180, 182 can be conductive so as to aid in crosstalk resonance dampening aspects.

Figure 6:
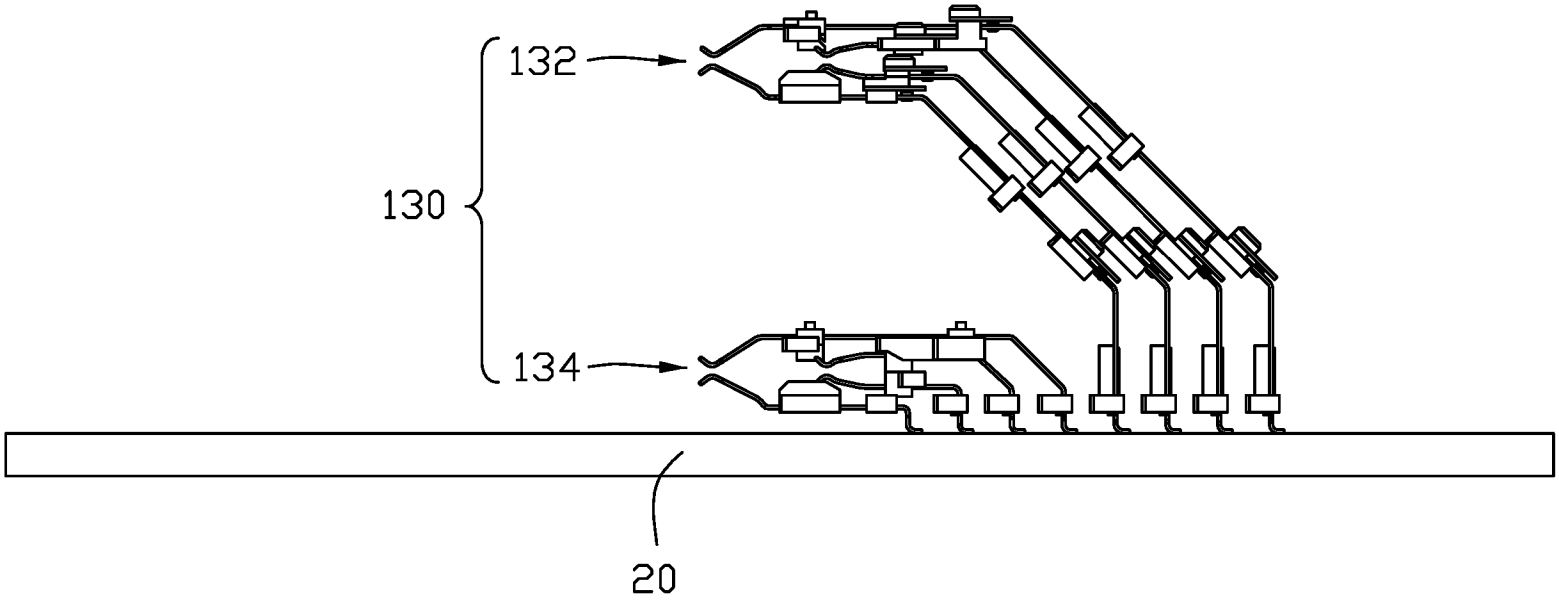
FIG. 6 is a side view of a contact module of an electrical connector assembly of the electrical device of FIG. 1.
Figure 7:
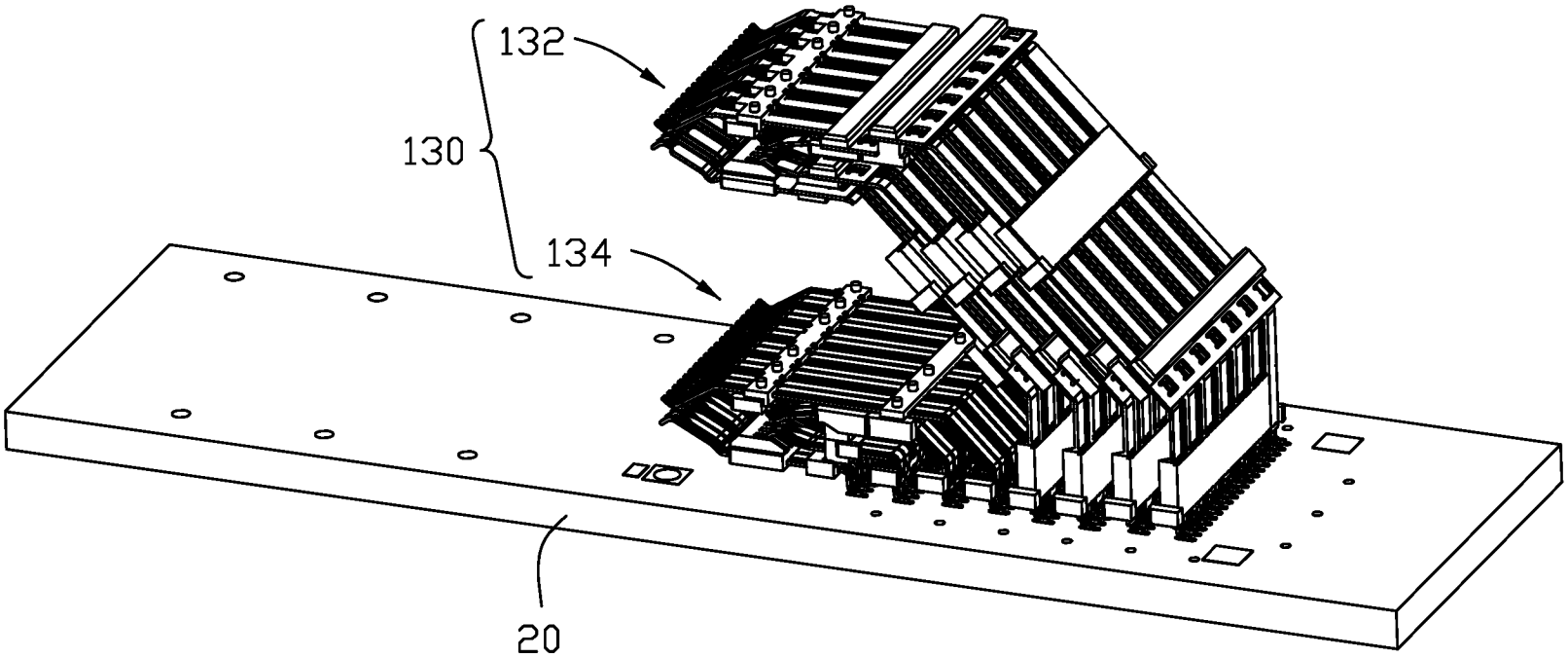
FIG. 7 is a perspective view of the contact module of the electrical connector assembly of the electrical device upon the printed circuit board of FIG. 6.
Figure 8A:
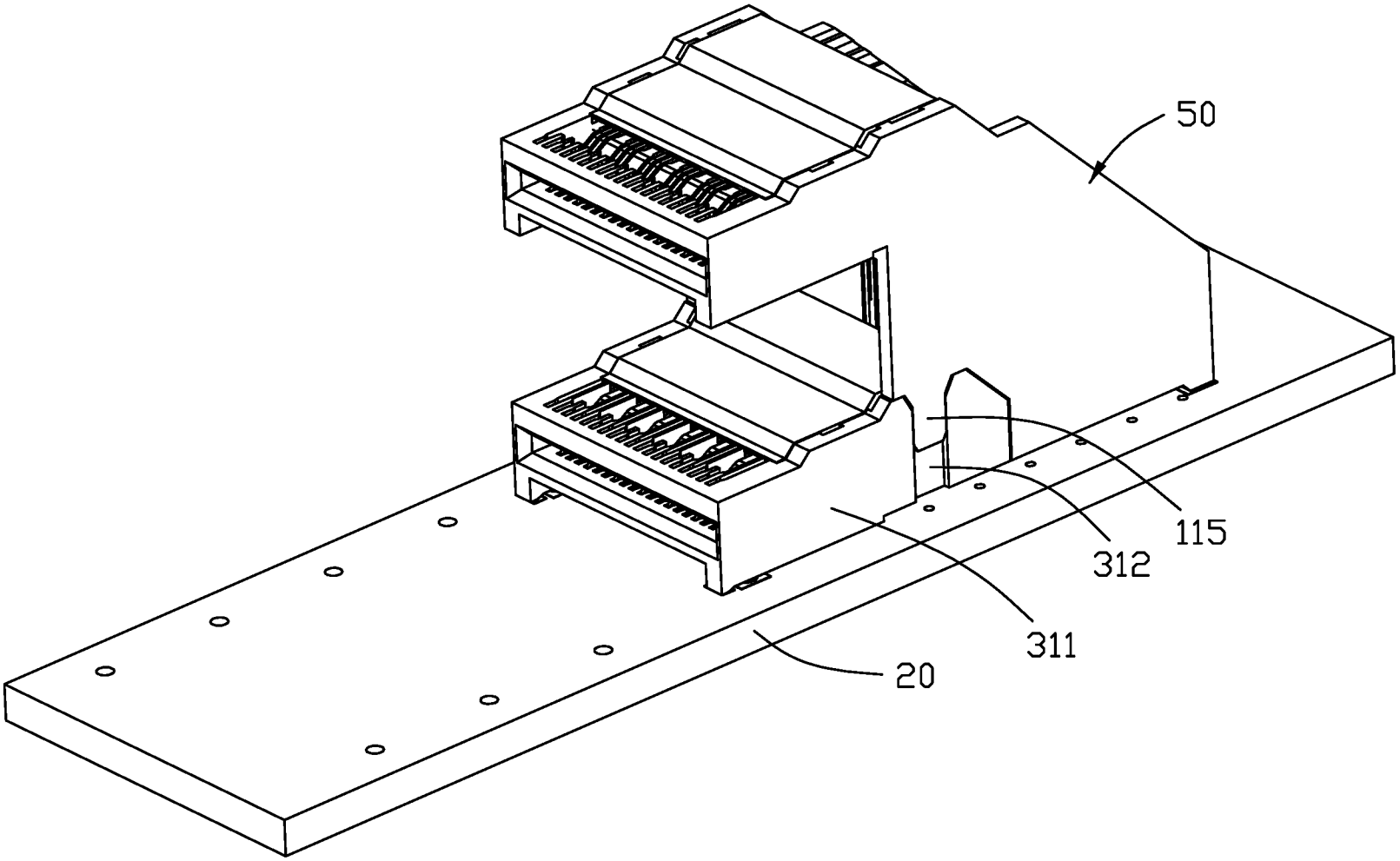
FIG. 8(A) is a perspective view of the electrical connector assembly of the electrical device upon the printed circuit board of FIG. 1.
Figure 8B:
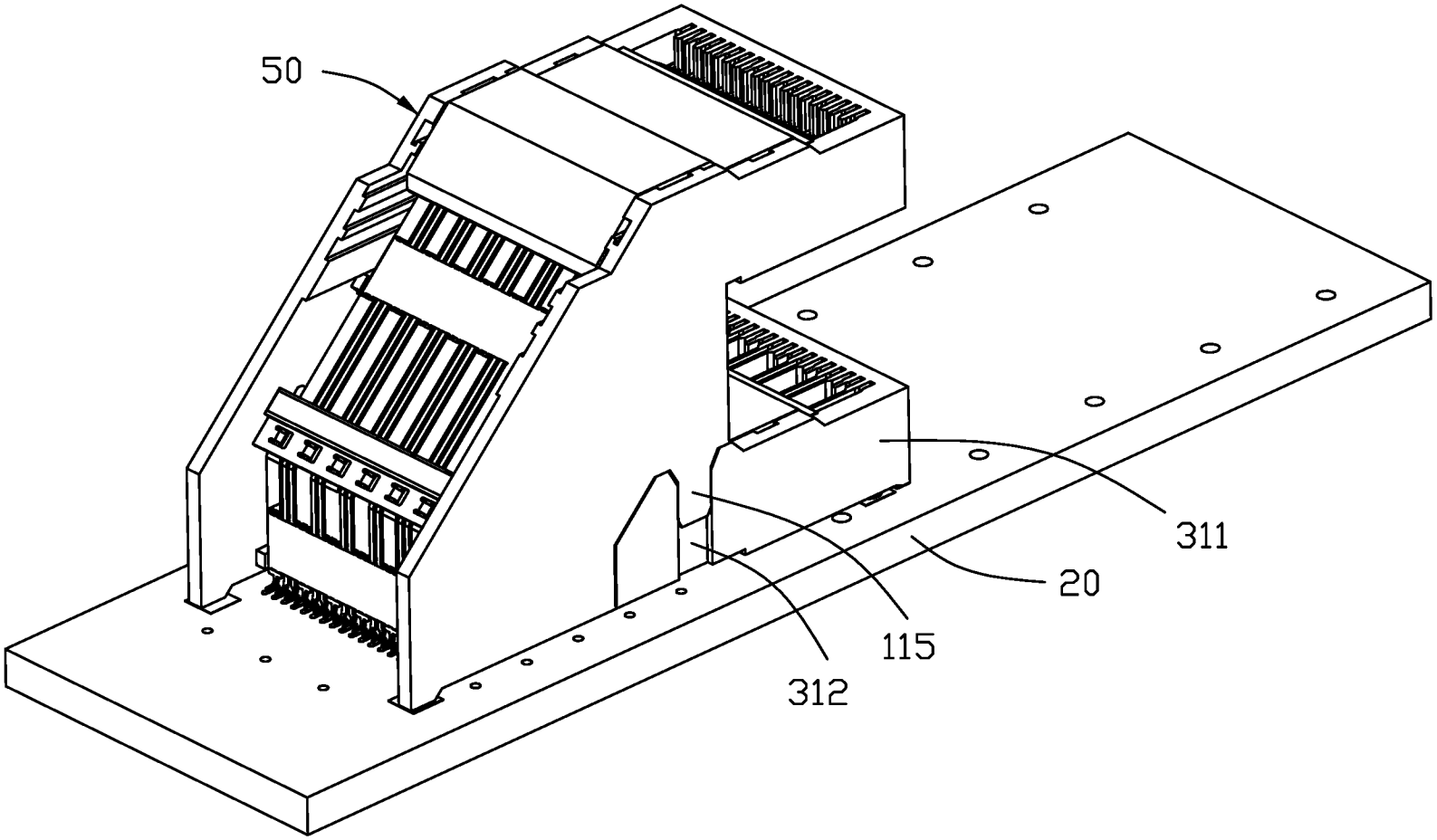
FIG. 8(B) is another perspective view of the electrical connector assembly of the electrical device upon the printed circuit board of FIG. 8(A)
Figure 9A:
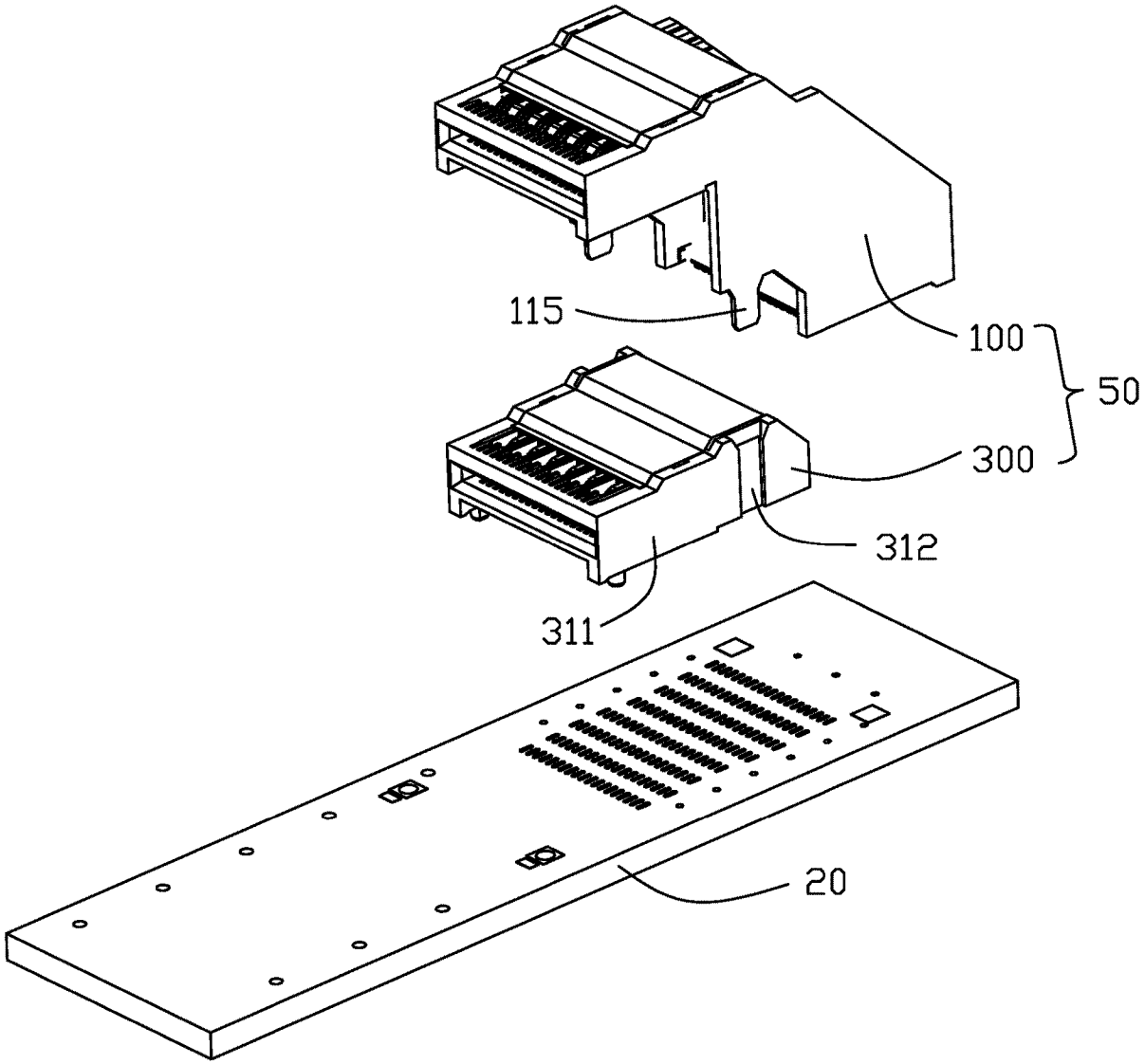
FIG. 9(A) is an exploded perspective view of the electrical connector assembly of the electrical device above the printed circuit board of FIG. 8(A)
Figure 9B:
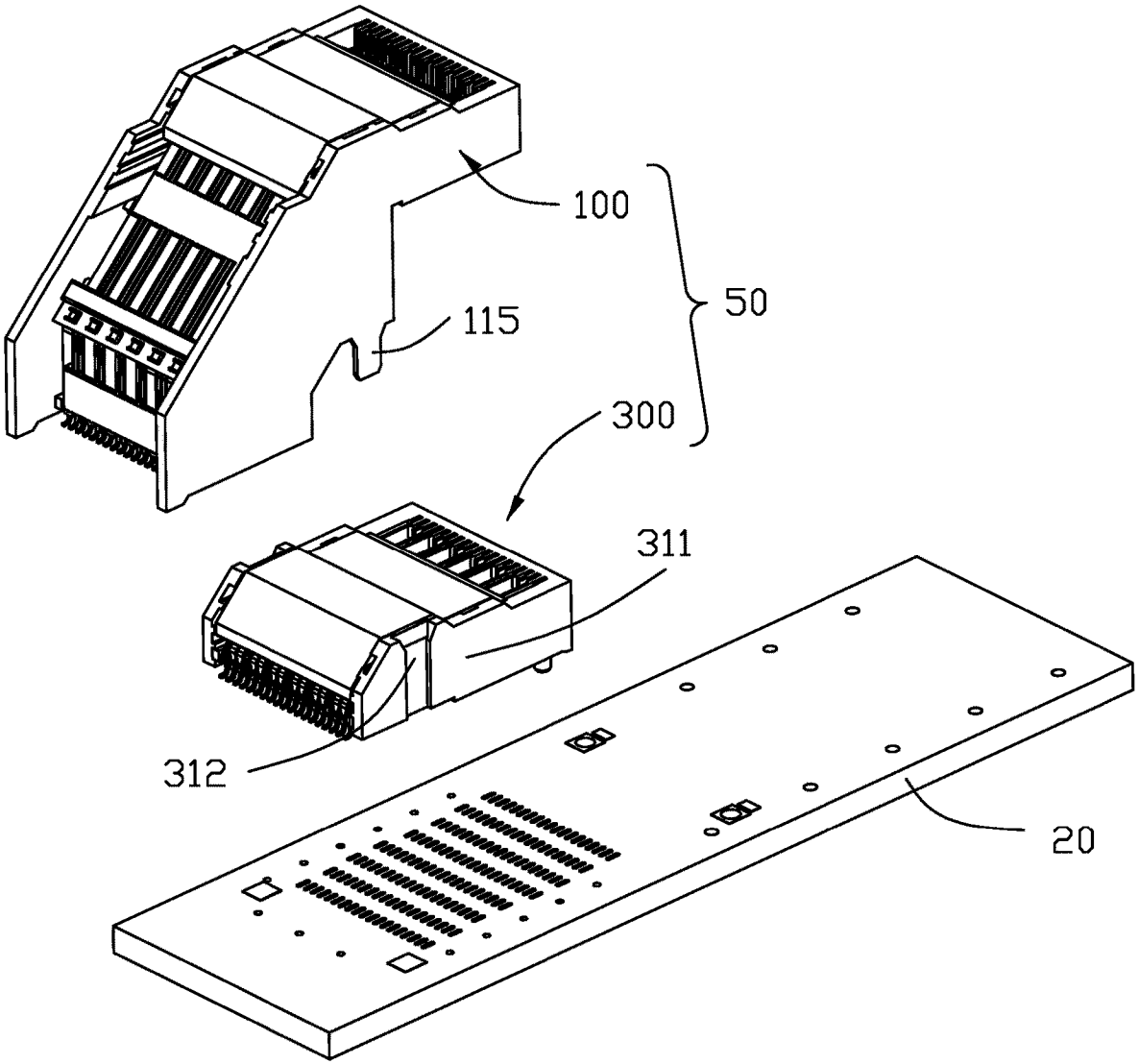
FIG. 9(B) is another exploded perspective view of the electrical connector assembly of the electrical device above the printed circuit board of FIG. 9(A)
Figure 10A:
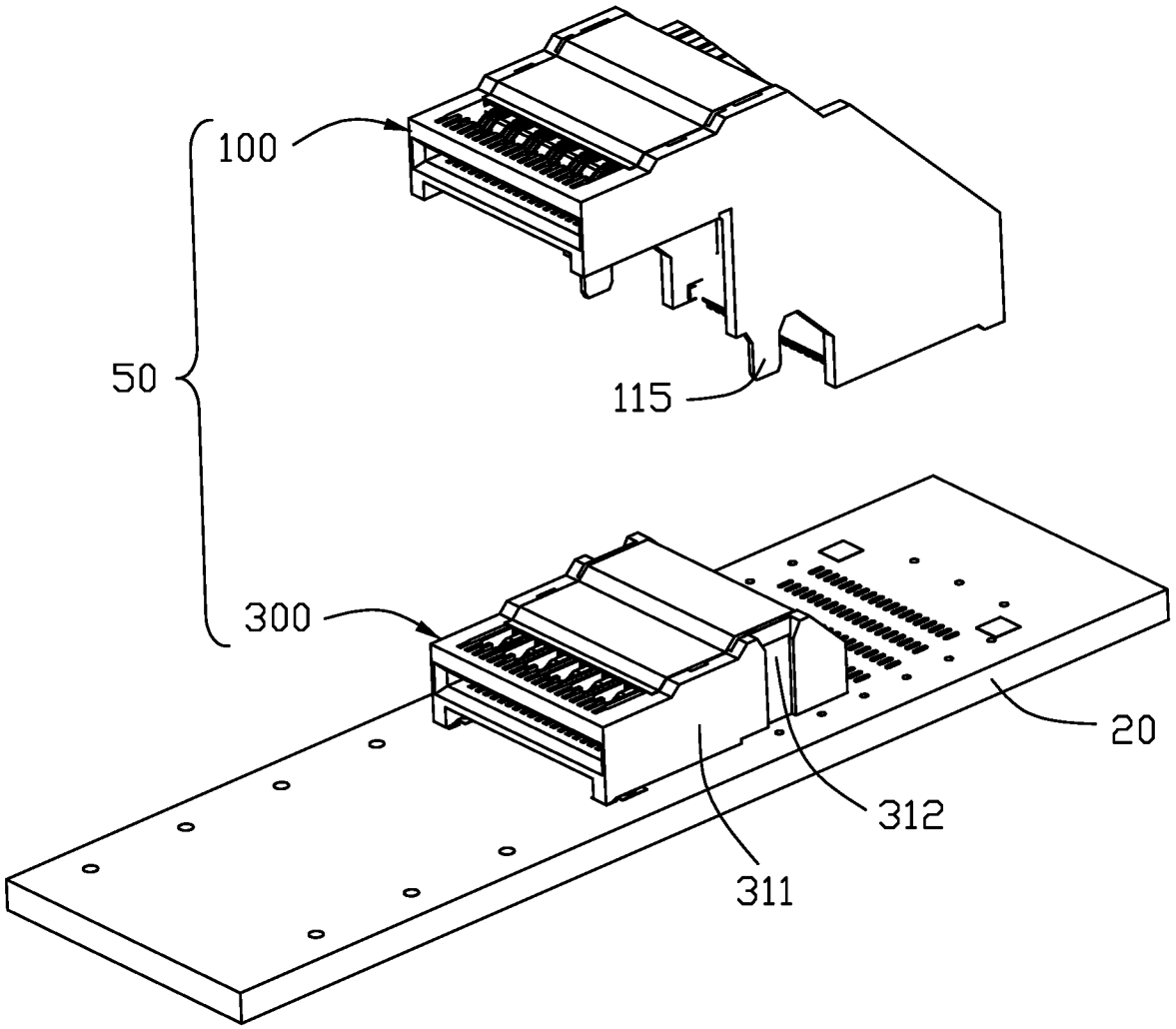
FIG. 10(A) is an exploded perspective view of the electrical connector assembly of the electrical device on the printed circuit board of FIG. 8(A) wherein an upper connector unit is moved away from a lower connector unit.
Figure 10B:
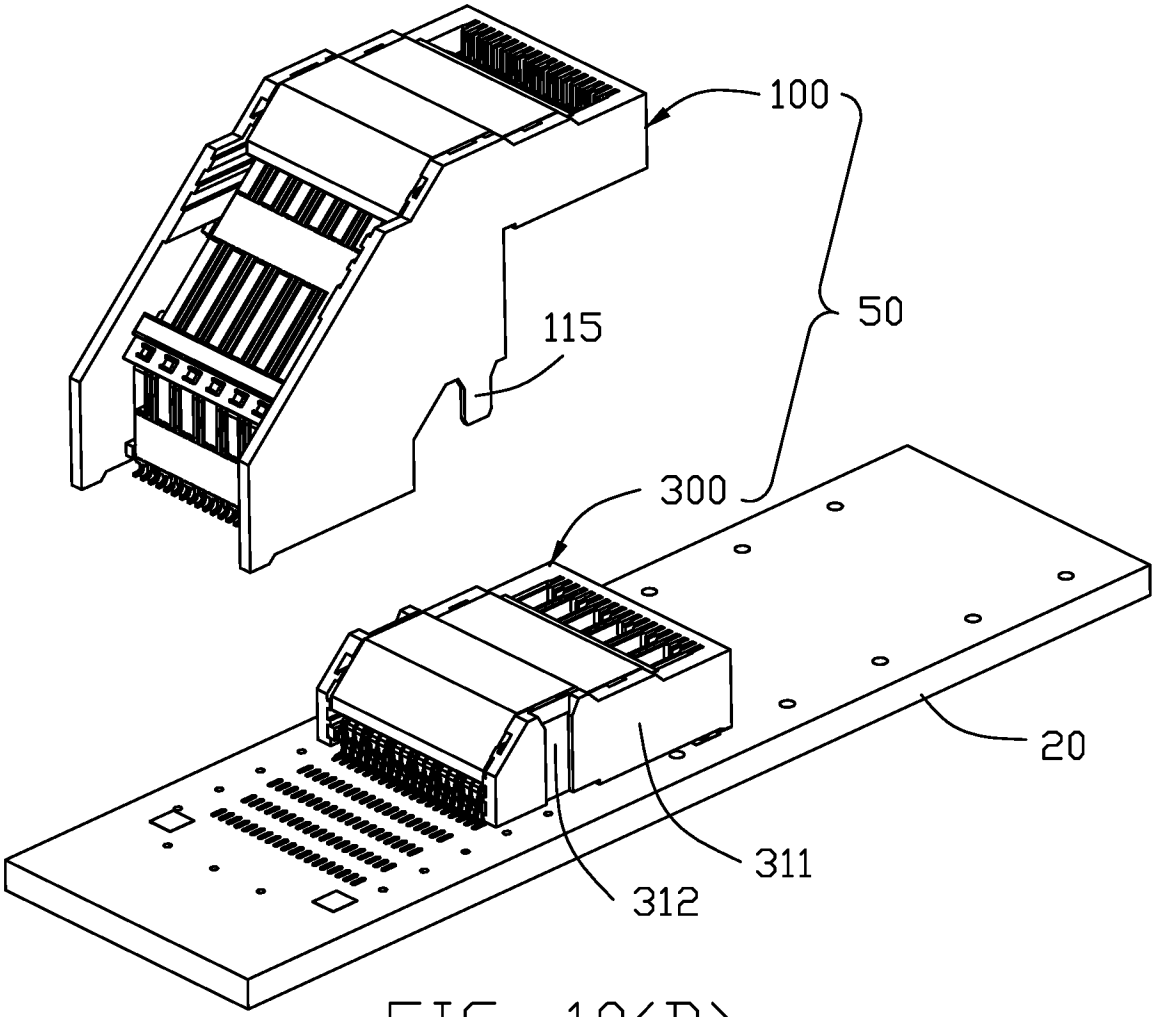
FIG. 10(B) is another exploded perspective view of the electrical connector assembly of the electrical device on the printed circuit board of FIG. 10(A)
Figure 11A:
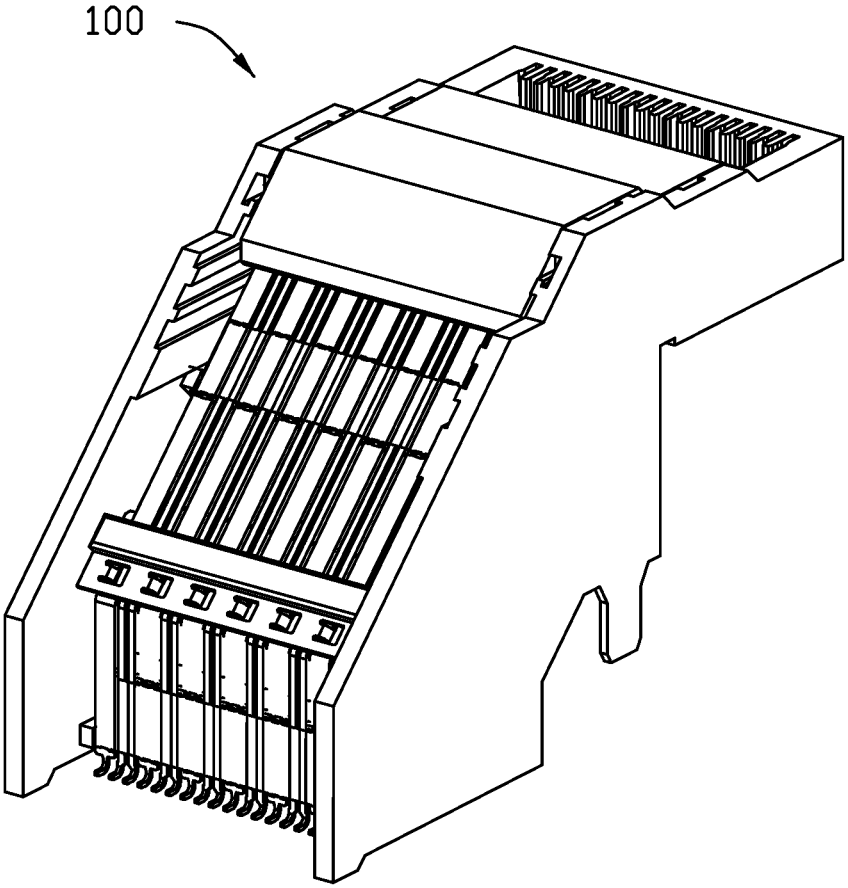
FIG. 11(A) is a perspective view of the upper connector unit of the electrical connector assembly of the electrical device of FIG. 10(A)
Figure 11B:
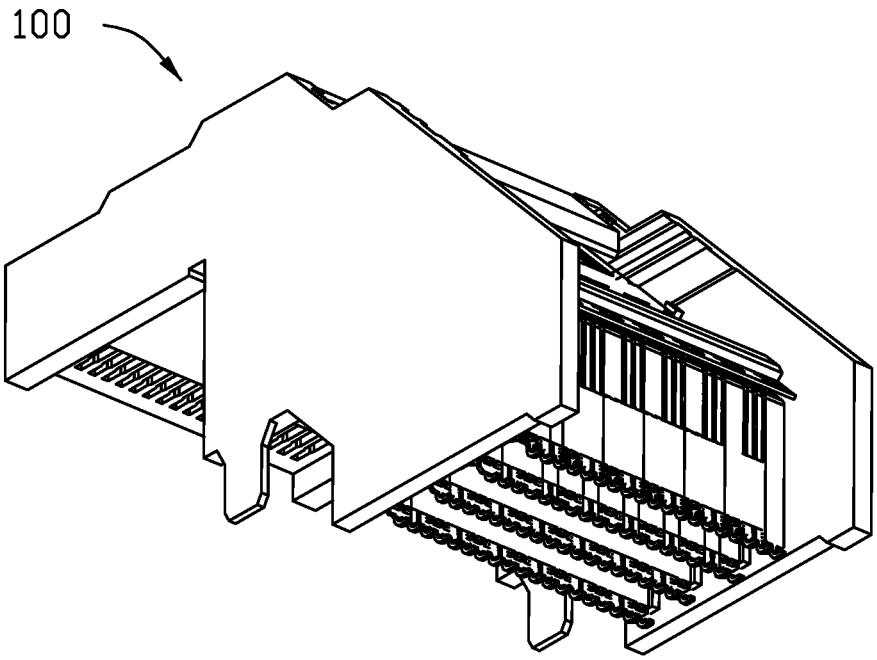
FIG. 11(B) is another perspective view of the upper connector unit of the electrical connector assembly of the electrical device of FIG. 11(A)
Figure 12:
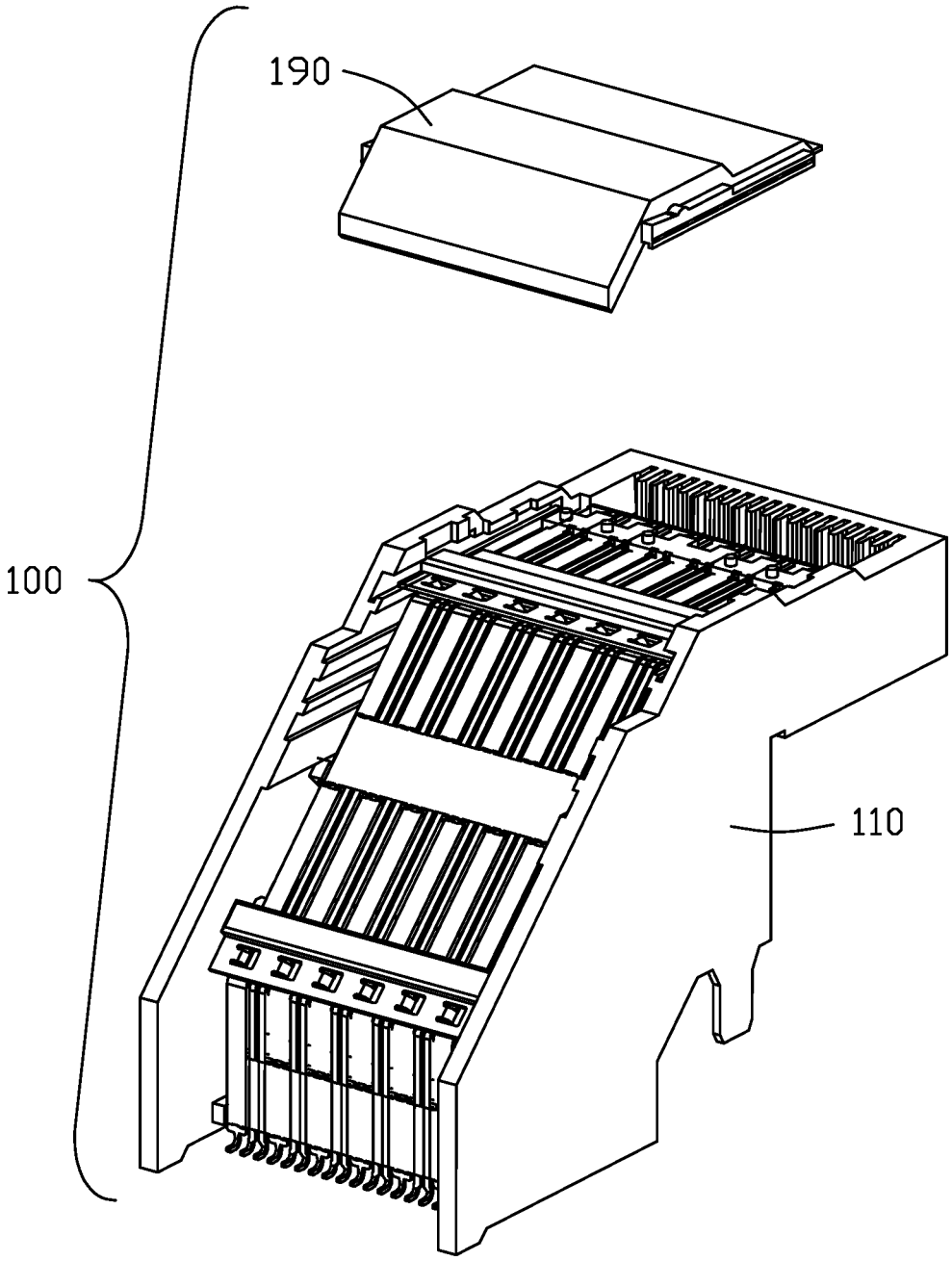
FIG. 12 is an exploded perspective view of the upper connector unit of the electrical connector assembly of the electrical device of FIG. 11(A)
Figure 13A:
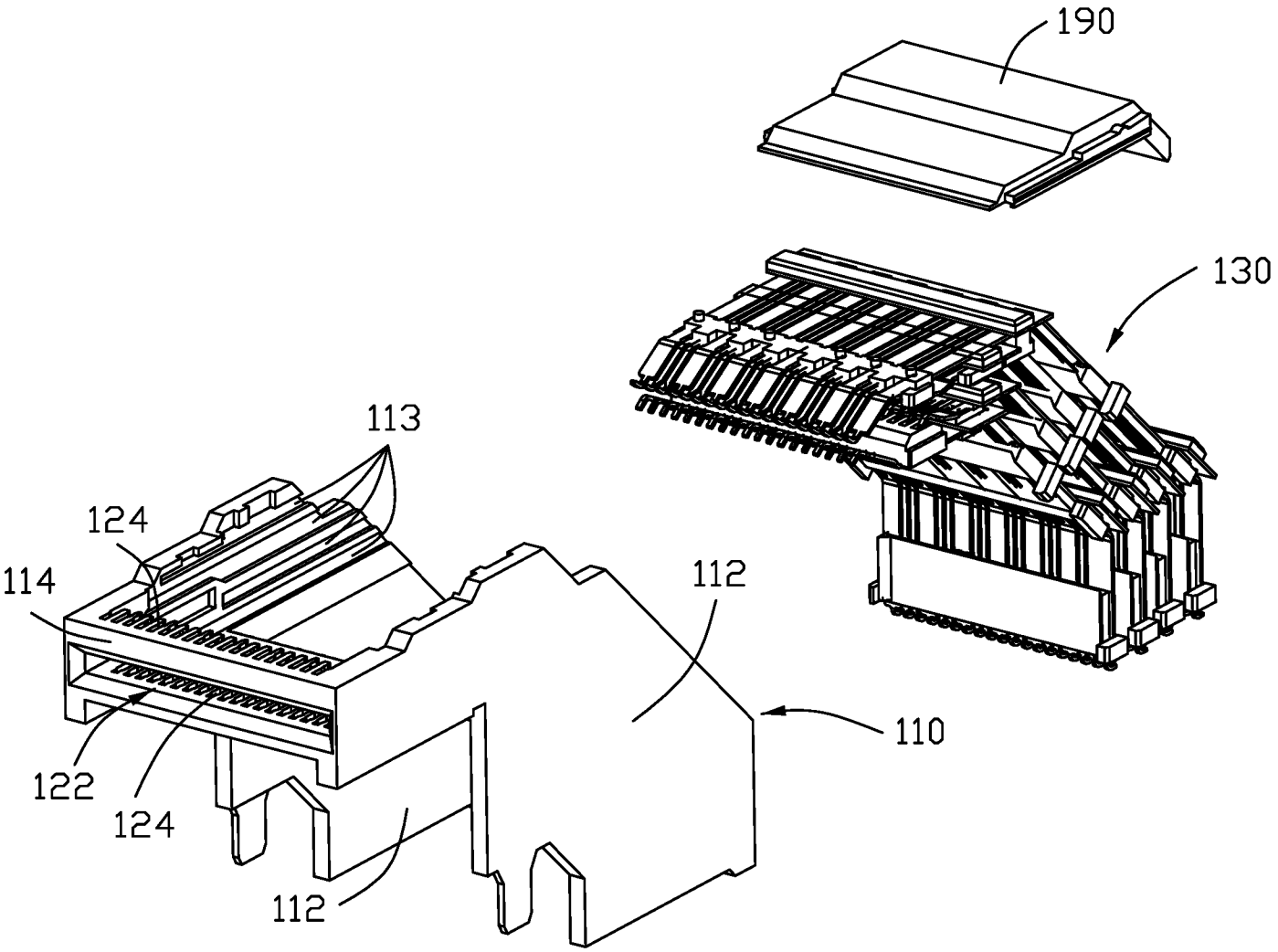
FIG. 13(A) is a further exploded perspective view of the upper connector unit of the electrical connector assembly of the electrical device of FIG. 12.
Figure 13B:
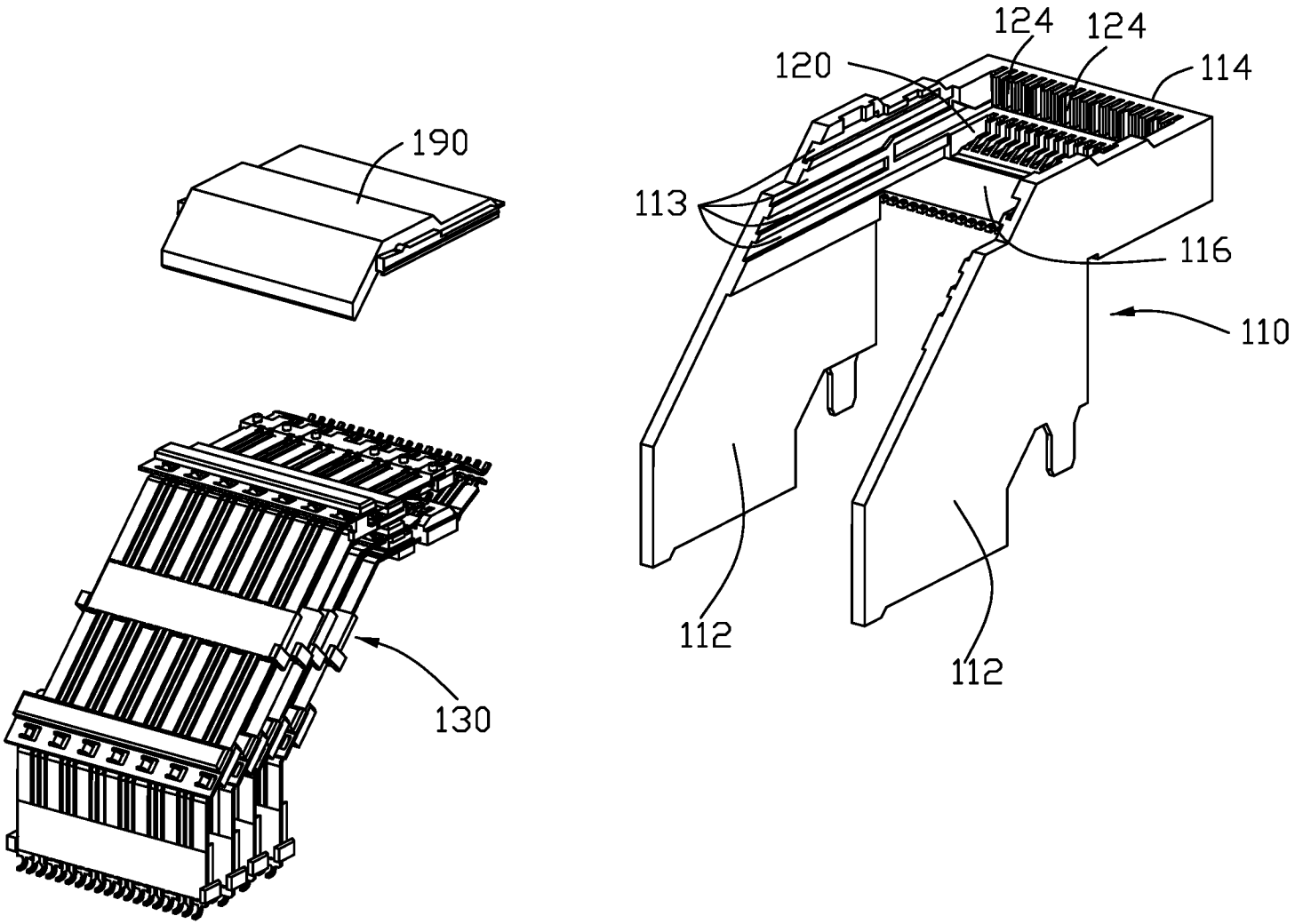
FIG. 13(B) is another exploded perspective view of the upper connector unit of the electrical connector assembly of the electrical device of FIG. 13(A)
Figure 14A:
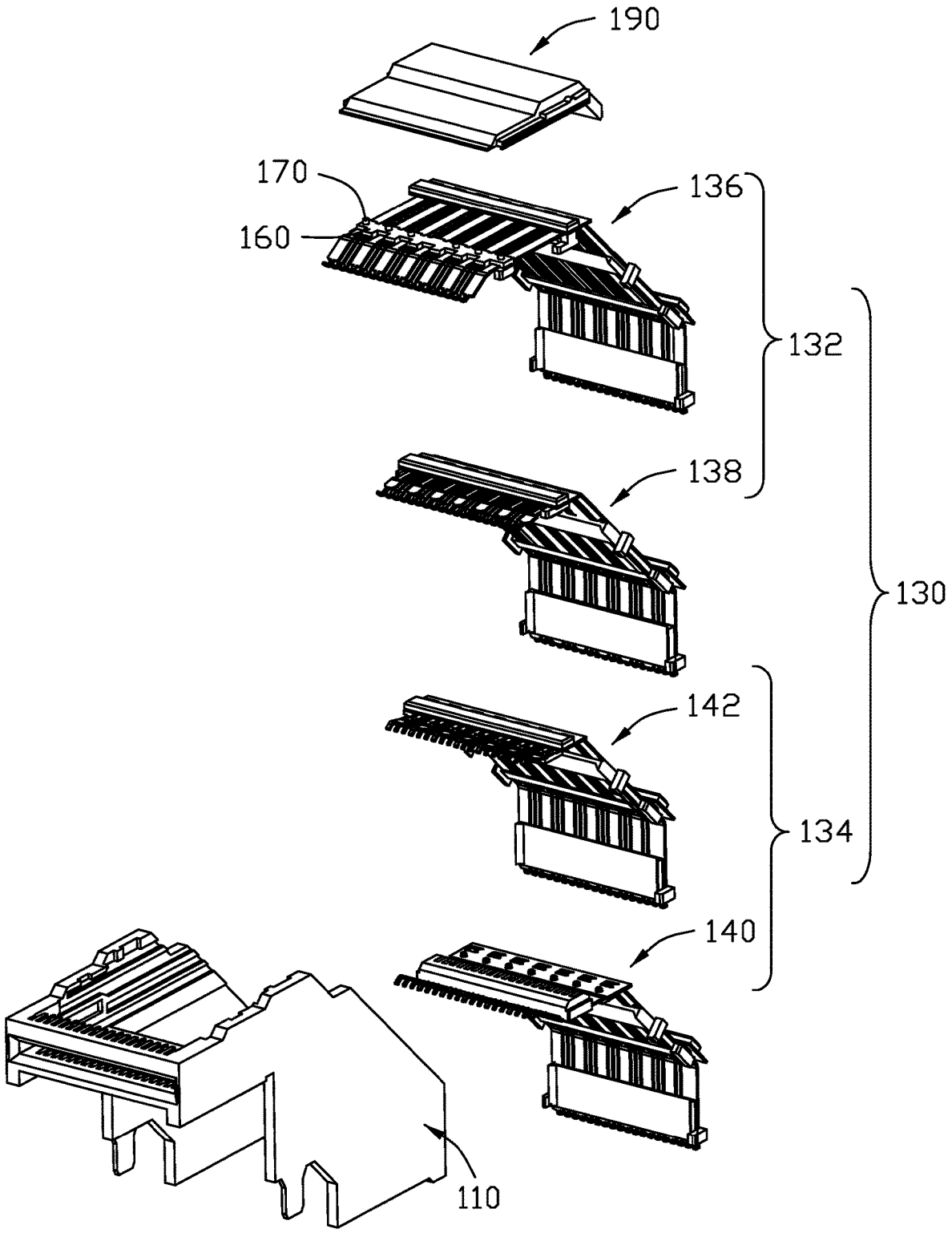
FIG. 14(A) is a further exploded perspective view of the upper connector unit of the electrical connector assembly of the electrical device of FIG. 13(A)
Figure 14B:
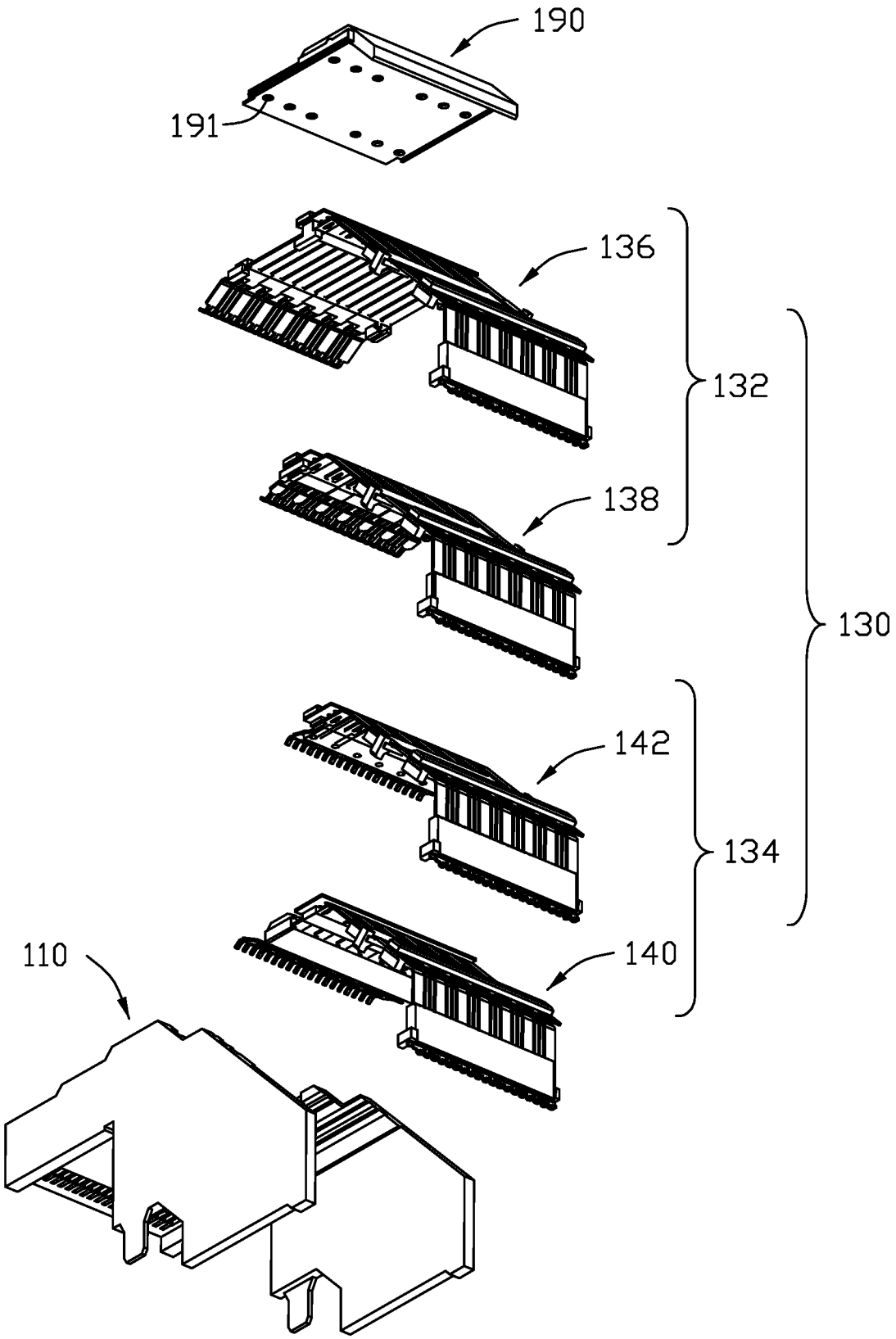
FIG. 14(B) is another exploded perspective view of the upper connector unit of the electrical connector assembly of the electrical device of FIG. 14(A)
Figure 15A:
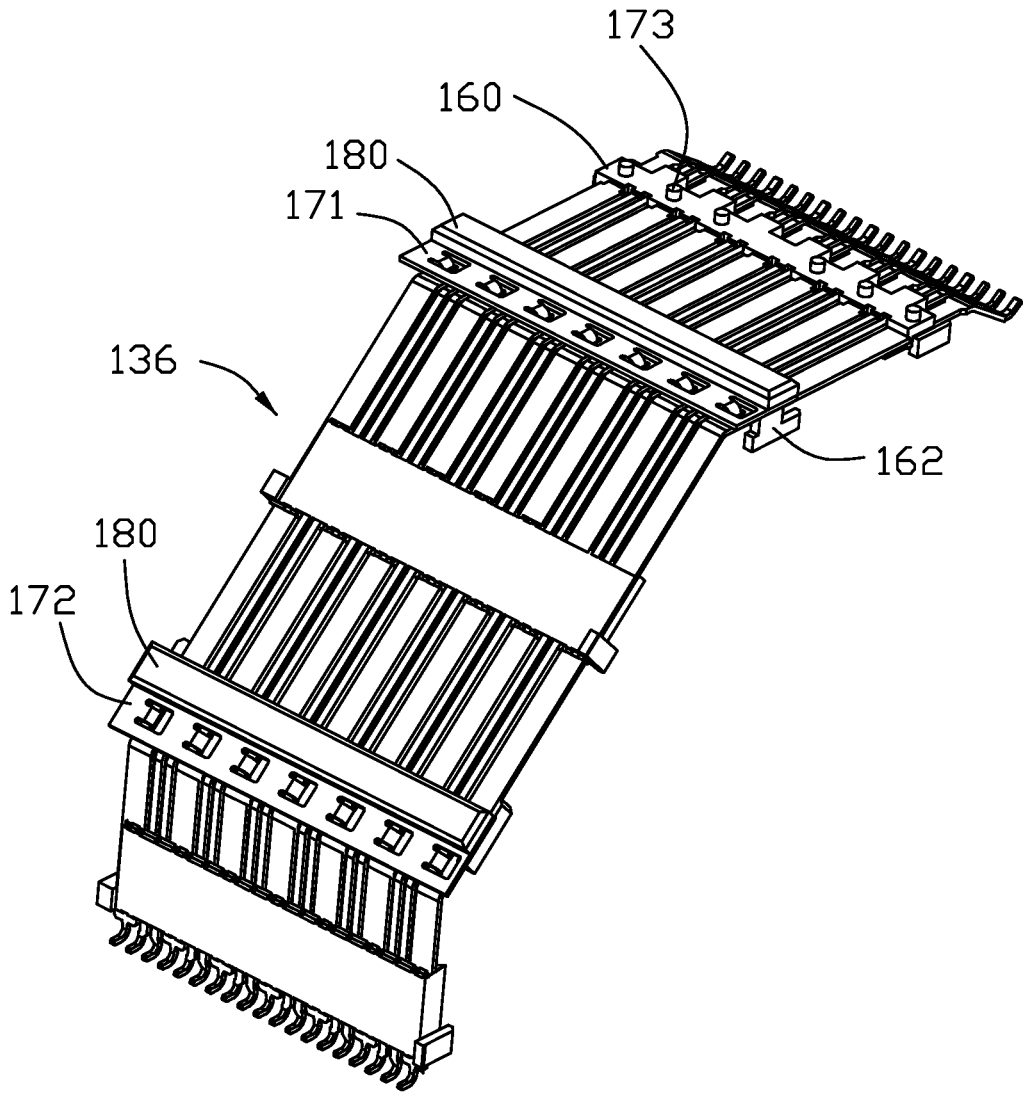
FIG. 15(A) is a perspective view of the upper front/outer contact part of the upper connector unit of the electrical connector assembly of the electrical device of FIG. 14(A)
Figure 15B:
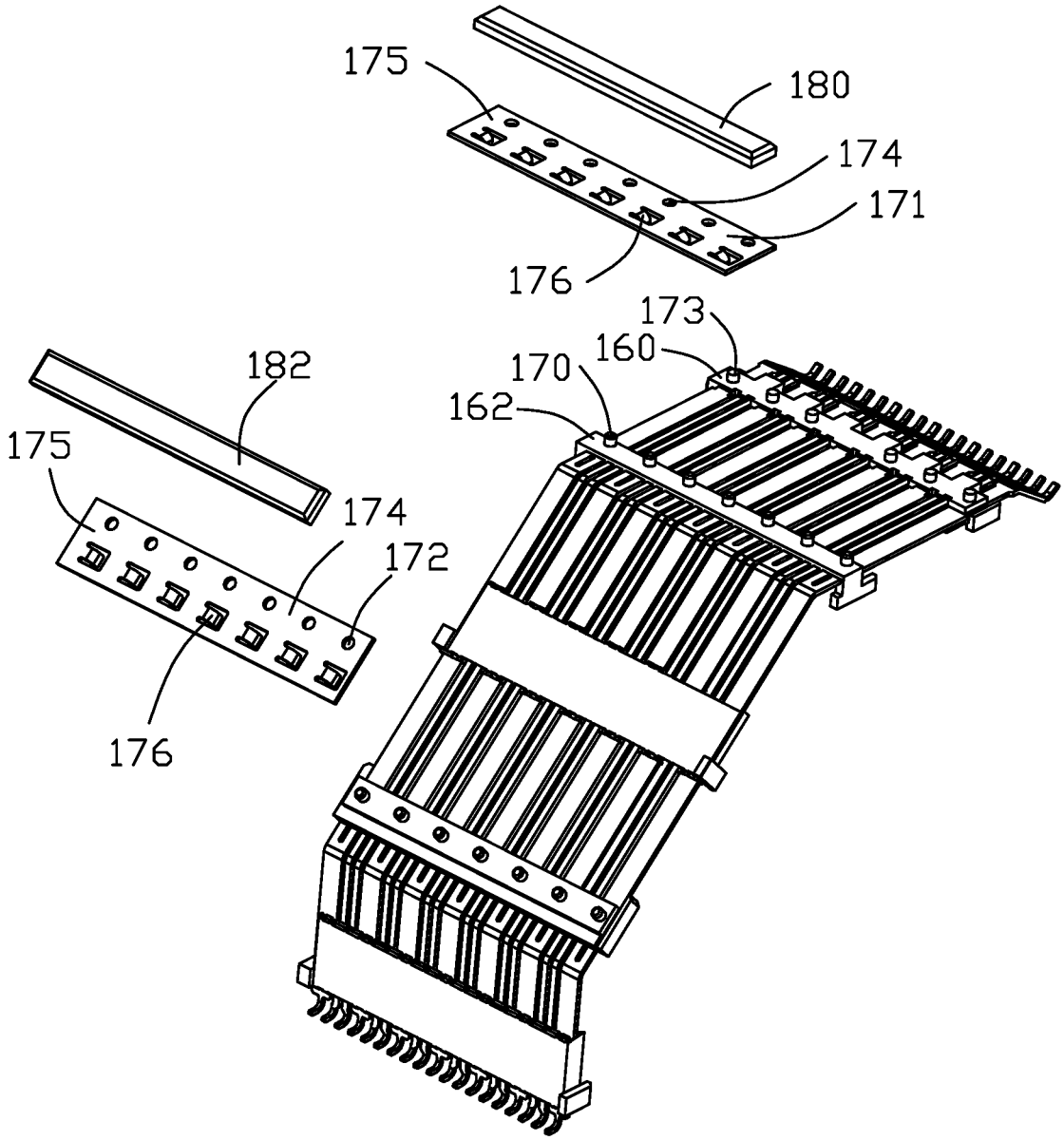
FIG. 15(B) is a further exploded perspective view of the upper front/outer contact part of the upper connector unit of the electrical connector assembly of the electrical device of FIG. 15(A)
Figure 15C:
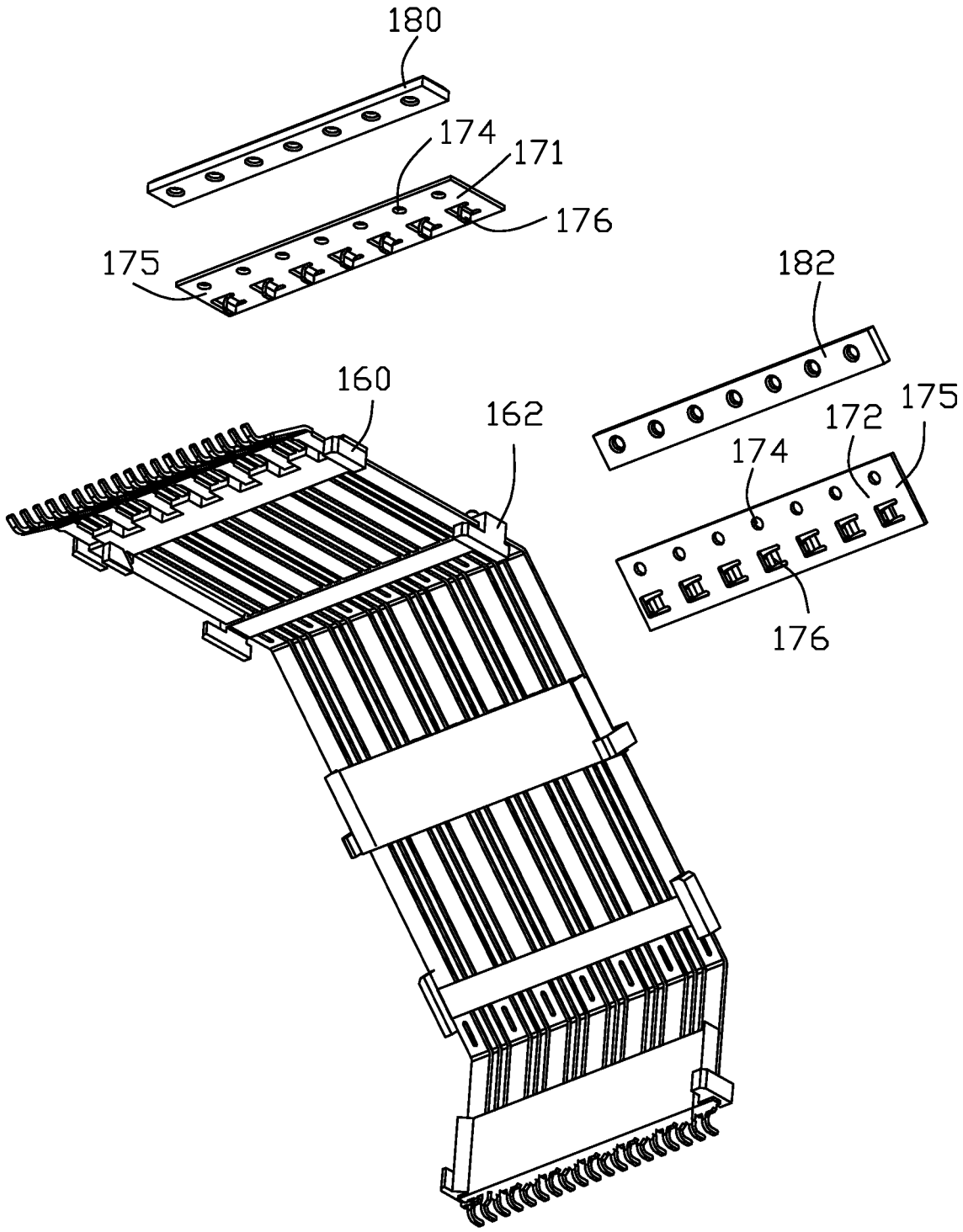
FIG. 15(C) is another exploded perspective view of the upper front/outer contact part of the upper connector unit of the electrical connector assembly of the electrical device of FIG. 15(B)
Figure 16A:
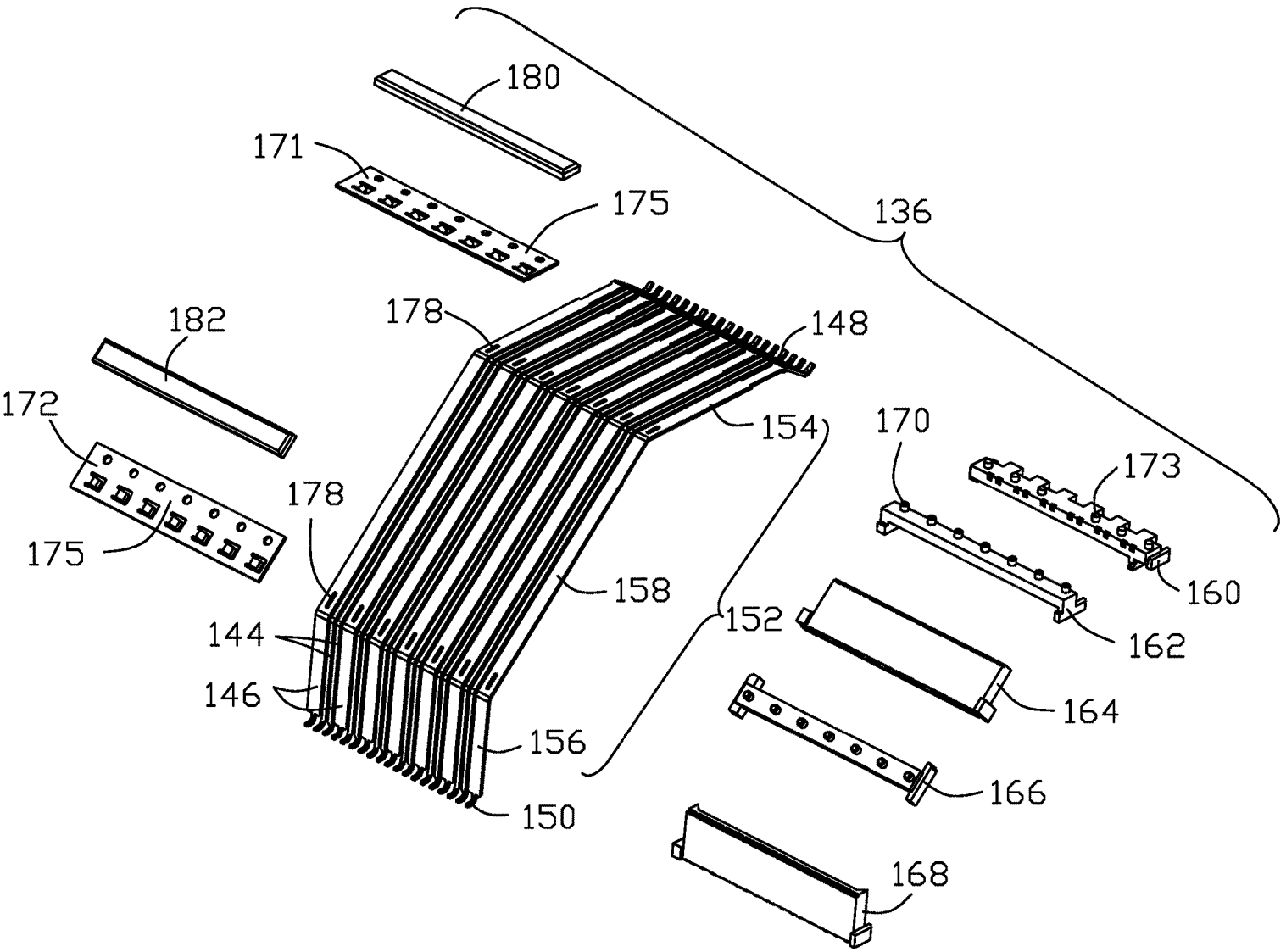
FIG. 16(A) is a further exploded perspective view of the upper front/outer contact part of the upper connector unit of the electrical connector assembly of the electrical device of FIG. 15(B)
Figure 16B:
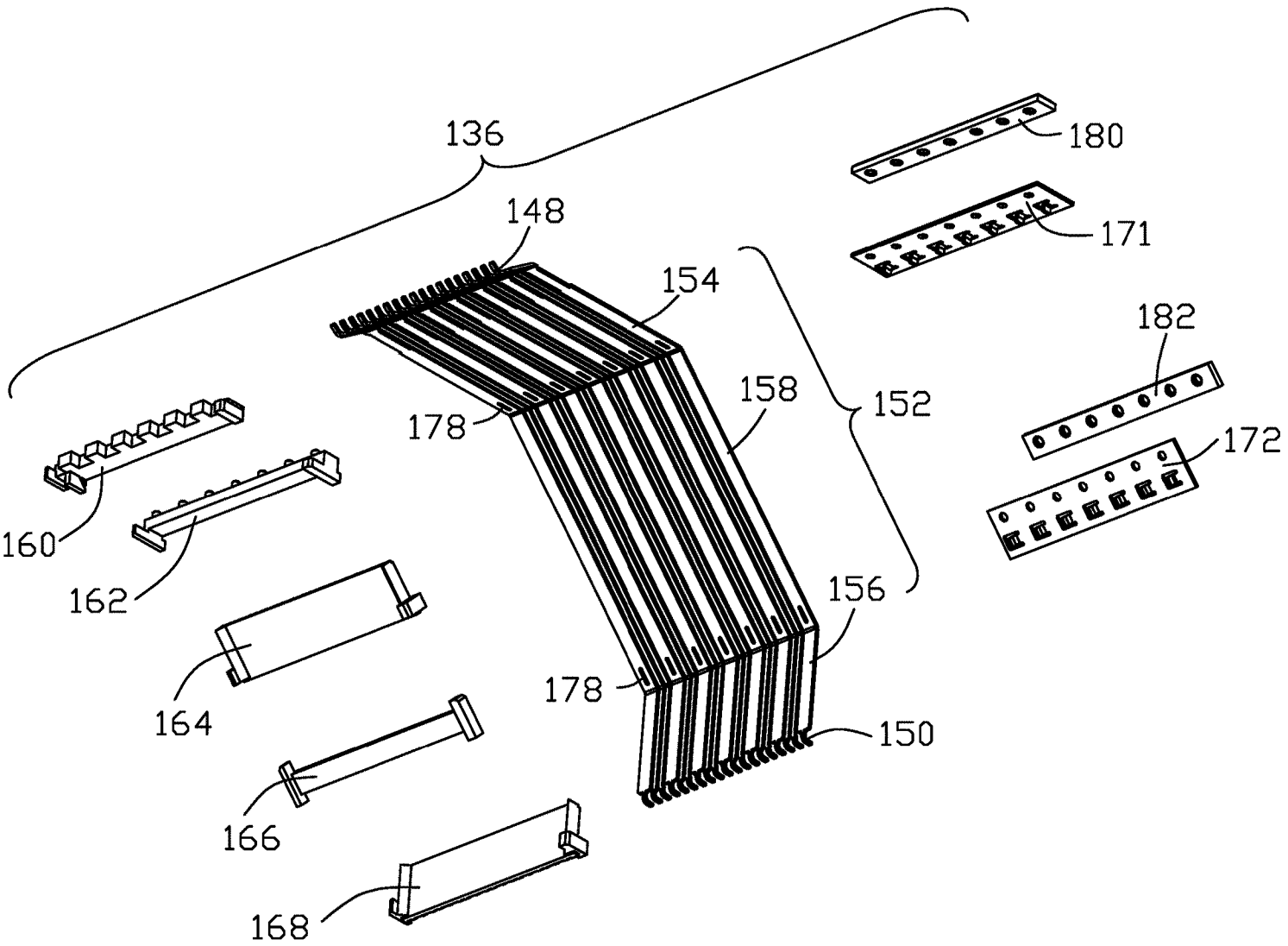
FIG. 16(B) is another exploded perspective view of the upper front/outer contact part of the upper connector unit of the electrical connector assembly of the electrical device of FIG. 16(A)
Figure 17:
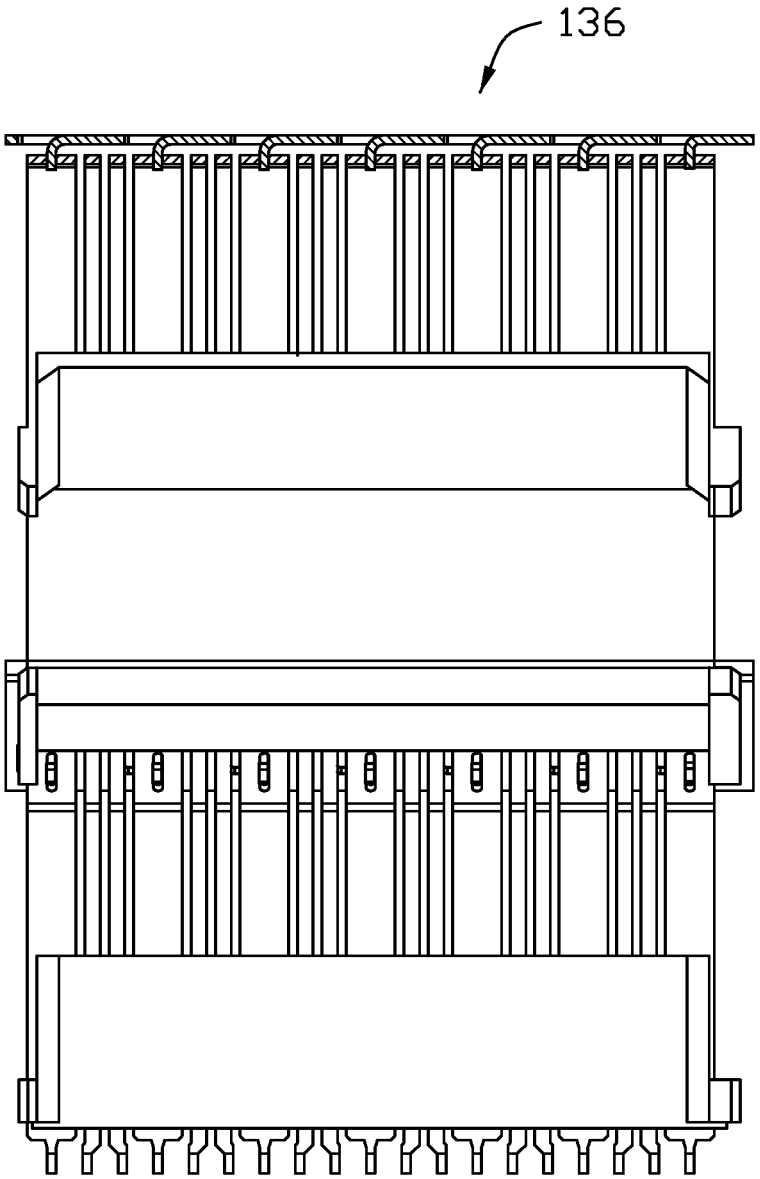
FIG. 17 is a cross-sectional view of the upper front/outer contact part of the upper connector unit of the electrical connector assembly of the electrical device of FIG. 15(A)
Figure 18A:
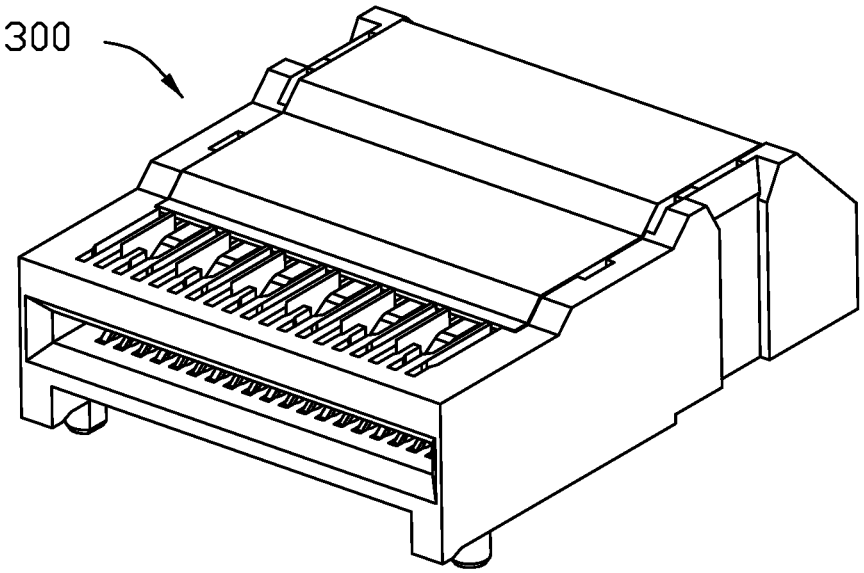
FIG. 18(A) is a perspective view of the lower connector unit of the electrical connector assembly of the electrical device of FIG. 9(A)
Figure 18B:
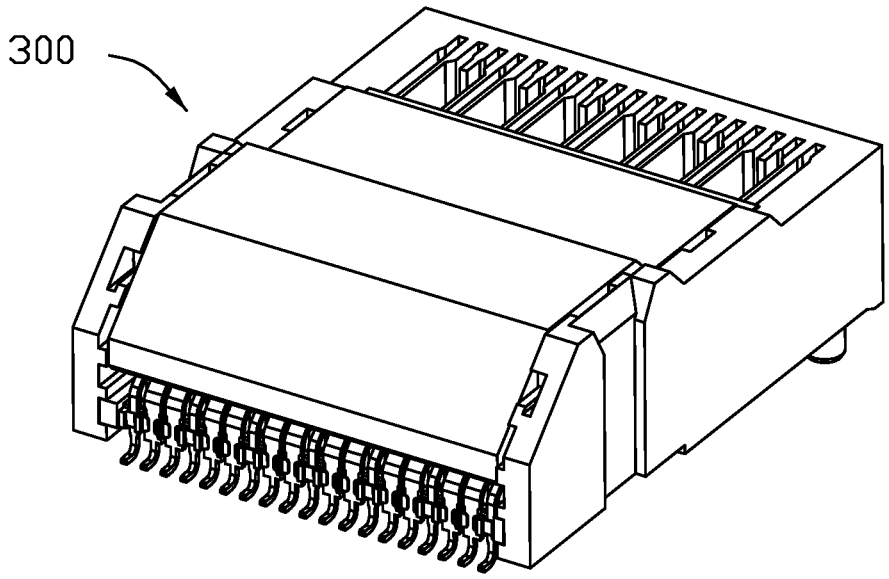
FIG. 18(B) is another perspective view of the lower connector unit of the electrical connector assembly of the electrical device of FIG. 18(A)
Figure 19:
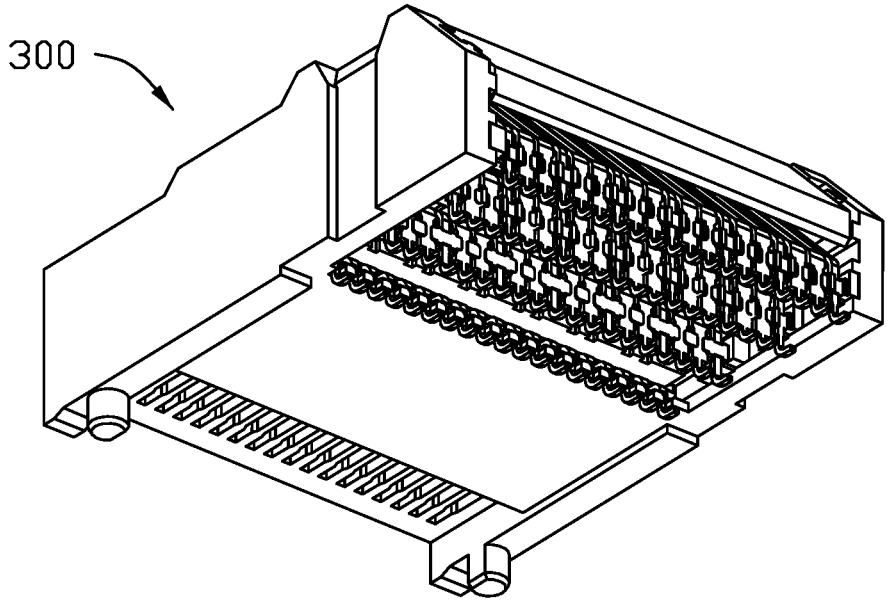
FIG. 19 is another perspective view of the lower connector unit of the electrical connector assembly of the electrical device of FIG. 18(A)
Figure 20:
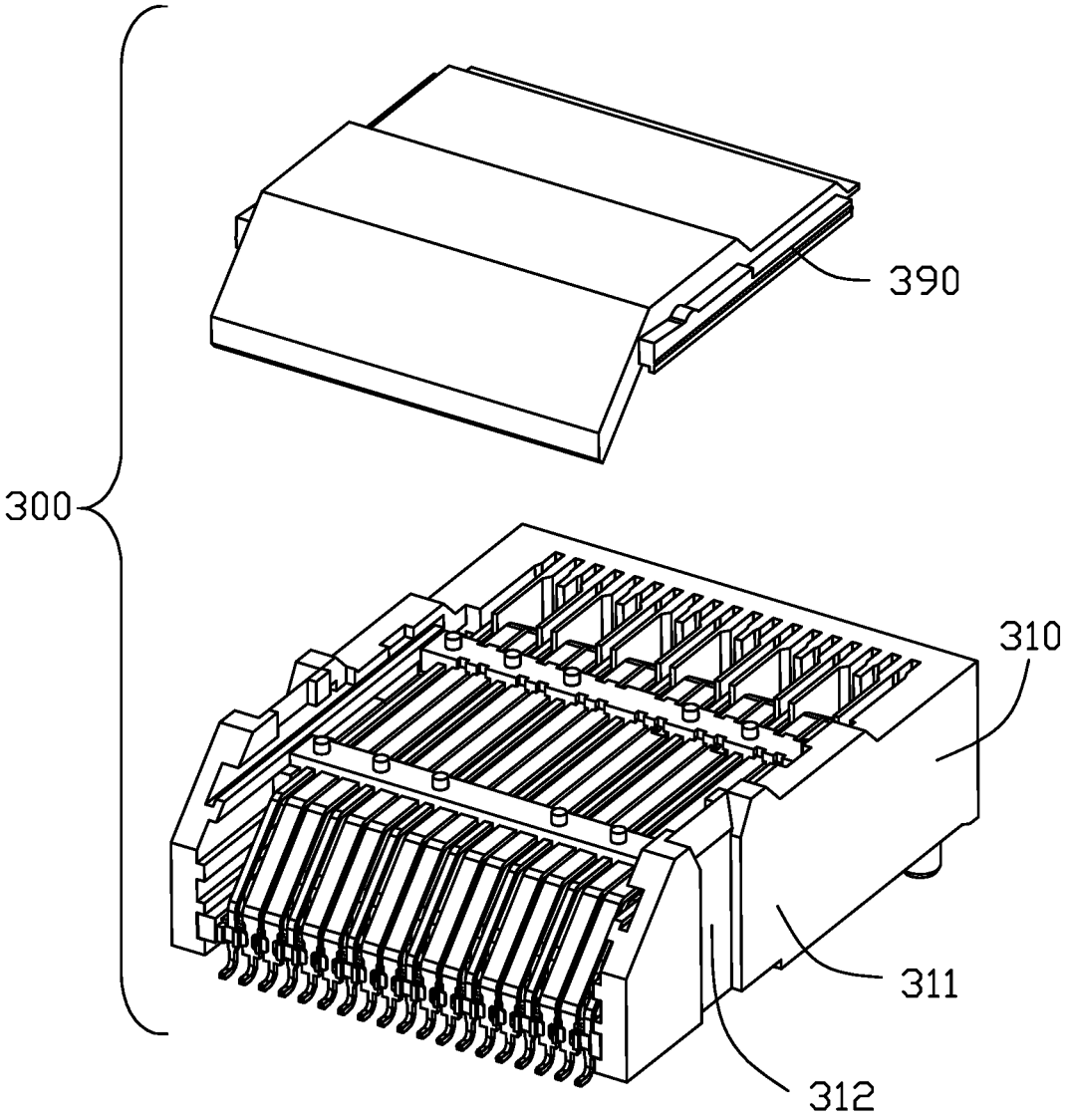
FIG. 20 is an exploded perspective view of the lower connector unit of the electrical connector assembly of the electrical device of FIG. 18(A)
Figure 21A:
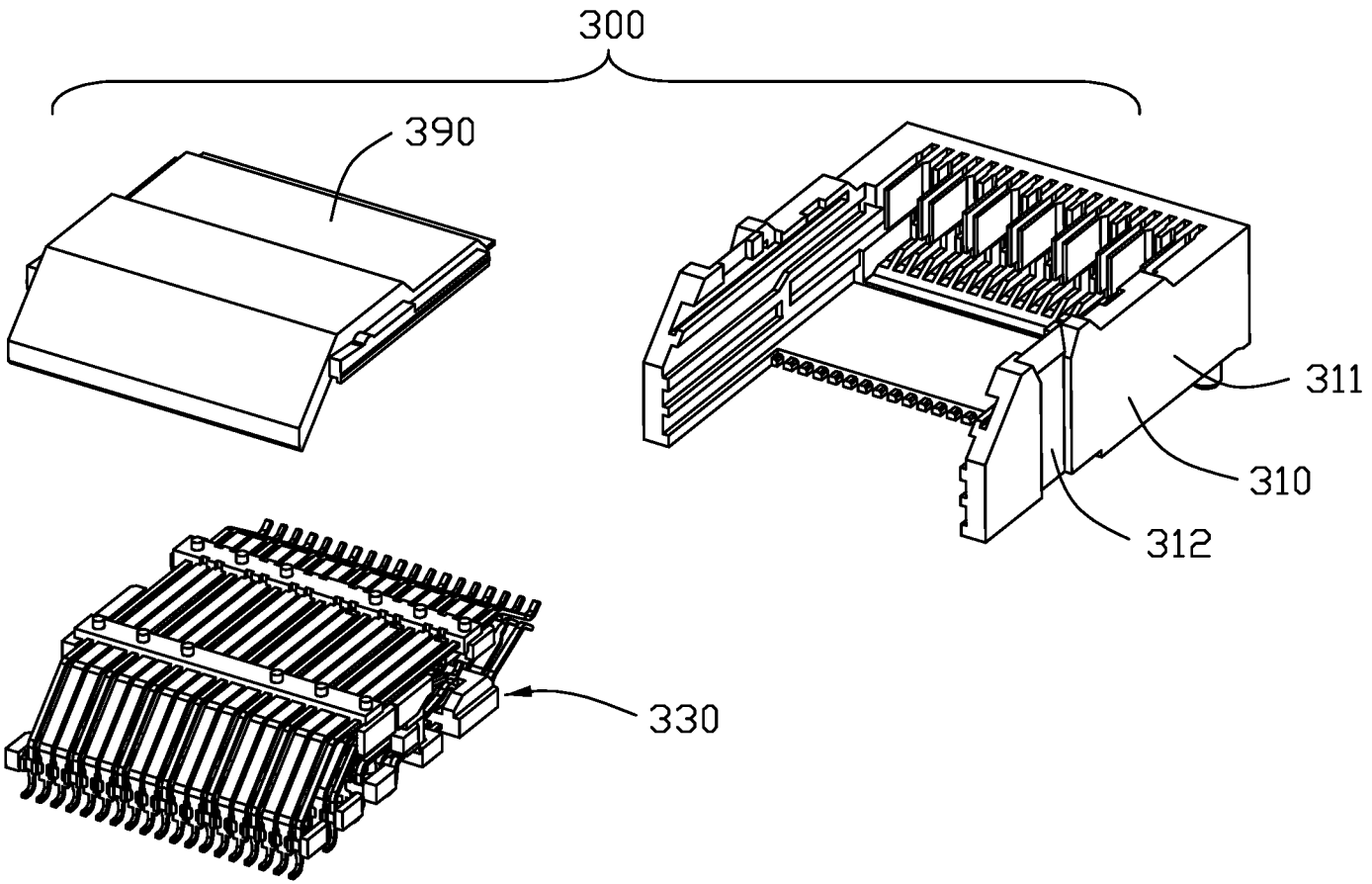
FIG. 21(A) is a further exploded perspective view of the lower connector unit of the electrical connector assembly of the electrical device of FIG. 20.
Figure 21B:
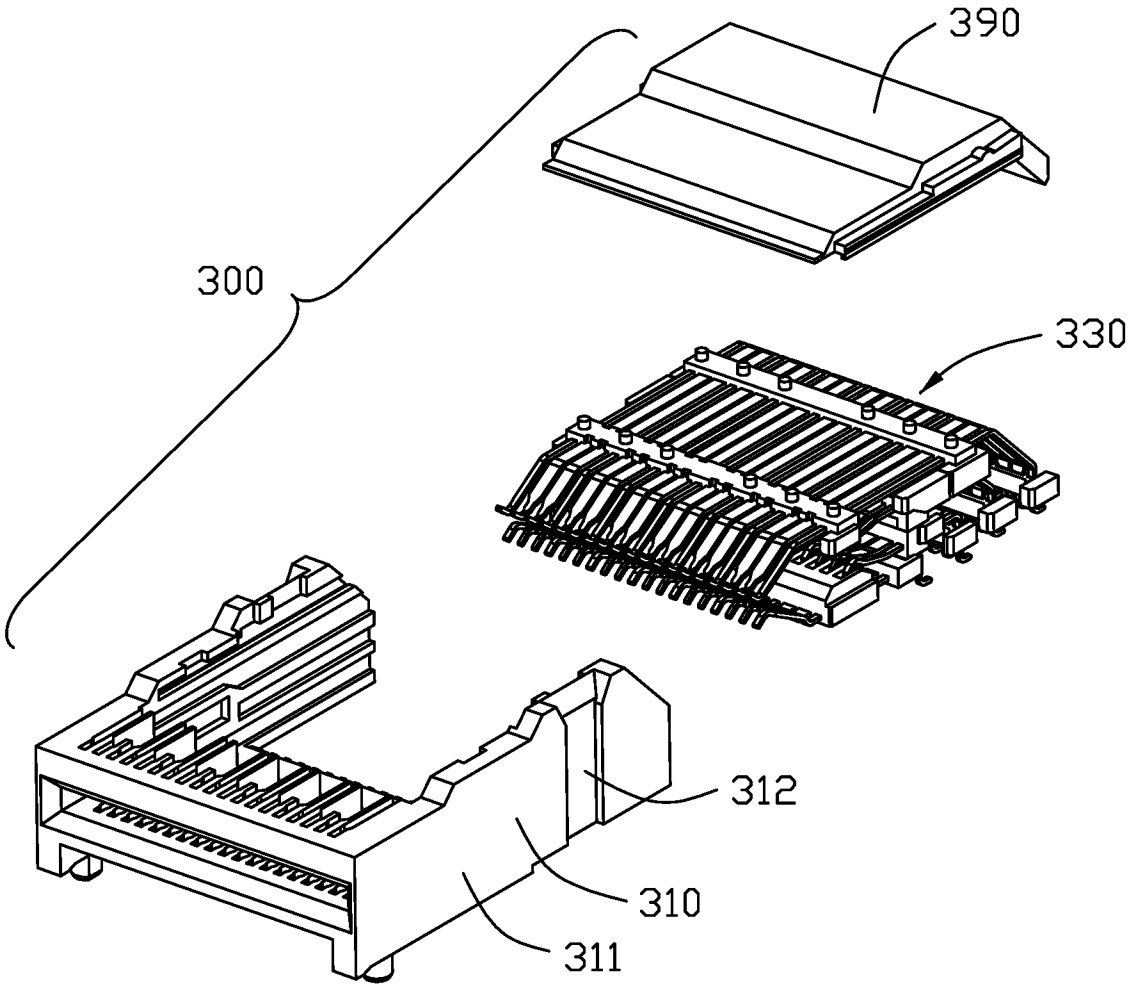
FIG. 21(B) is another exploded perspective view of the lower connector unit of the electrical connector assembly of the electrical device of FIG. 21(A)
Figure 22A:
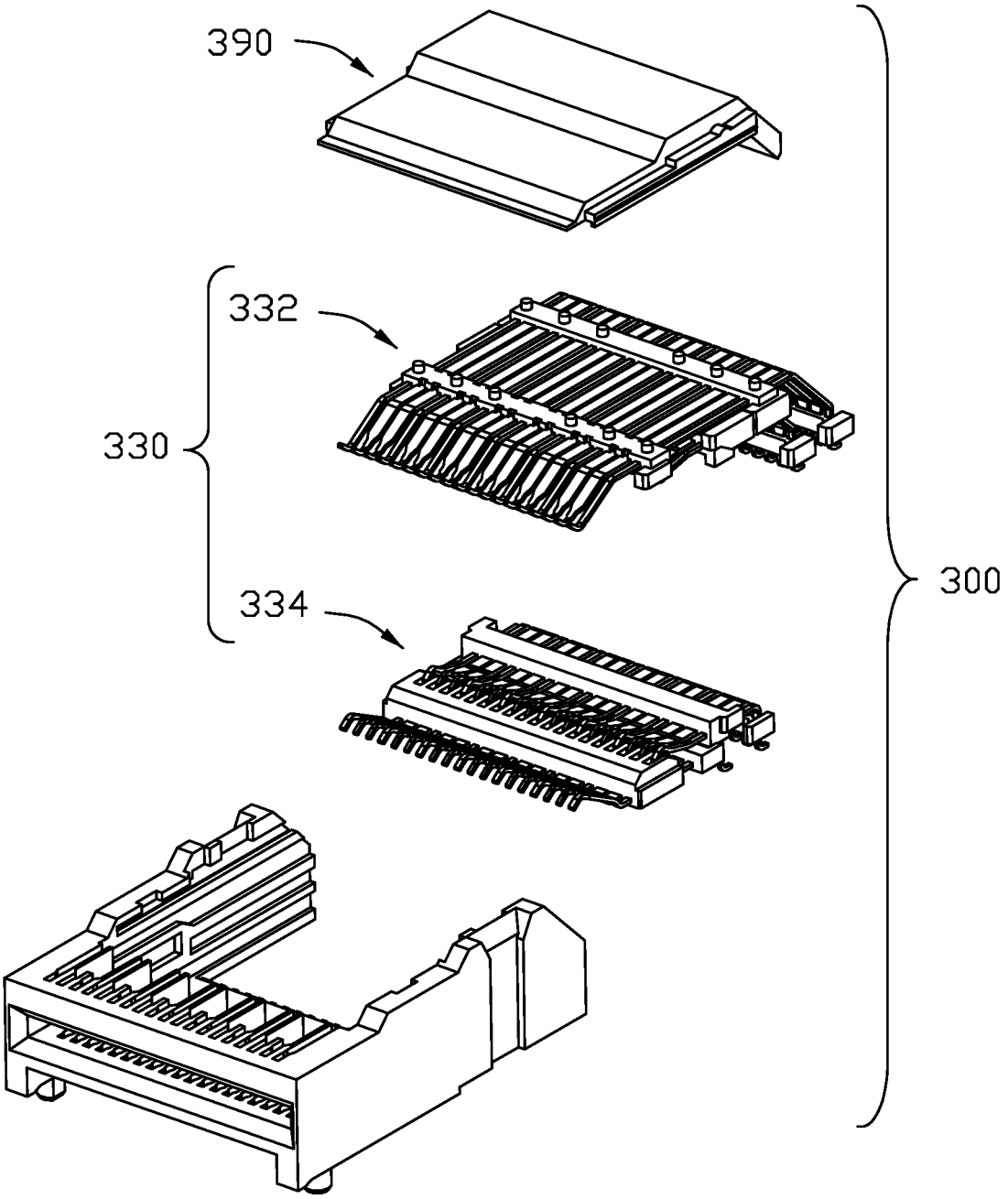
FIG. 22(A) is a further exploded perspective view of the lower connector unit of the electrical connector assembly of the electrical device of FIG. 21(A)
Figure 22B:
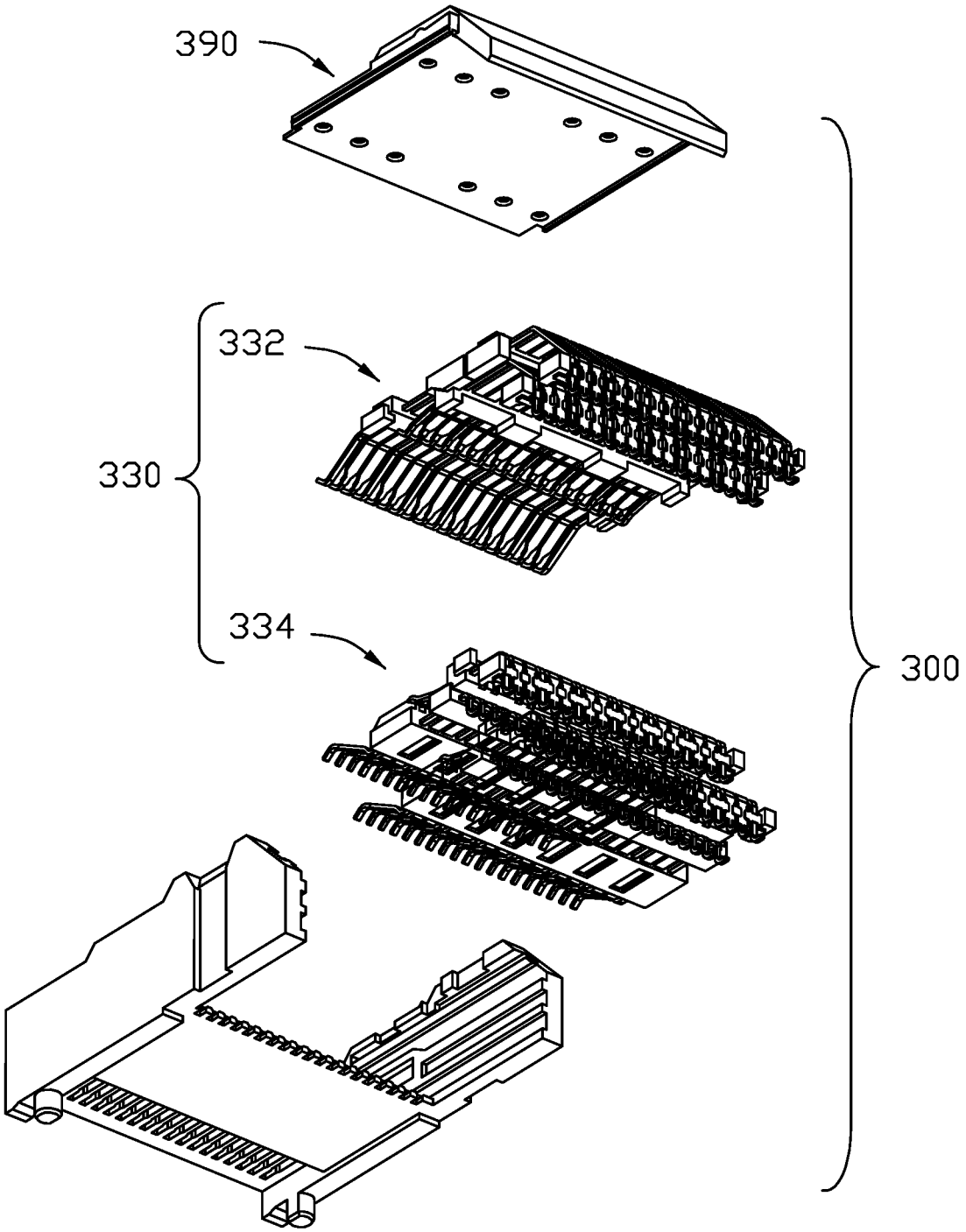
FIG. 22(B) is another perspective view of the lower connector unit of the electrical connector assembly of the electrical device of FIG. 22(A)
Figure 23A:
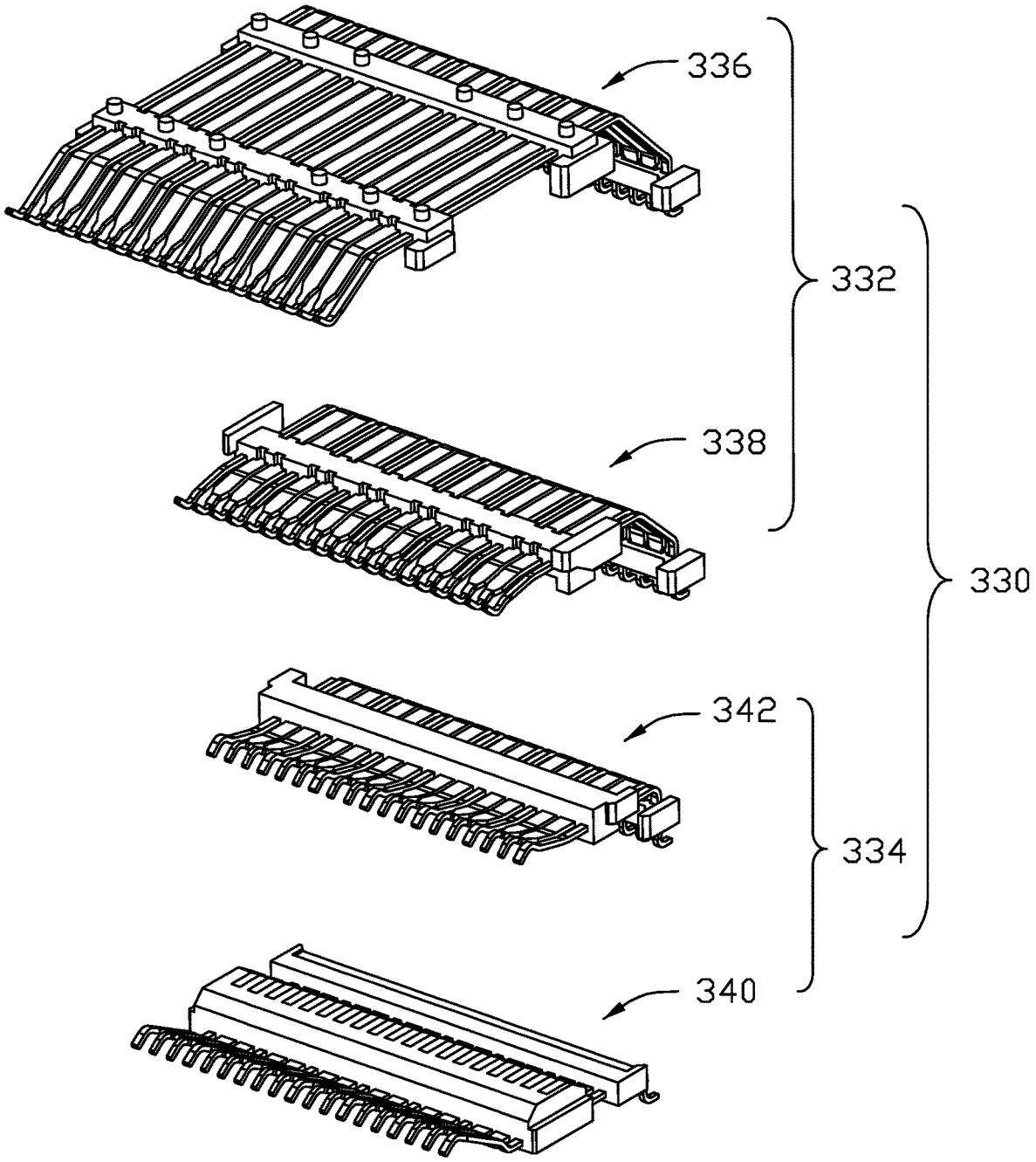
FIG. 23(A) is a further exploded perspective view of the contact module of the lower connector unit of the electrical connector assembly of the electrical device of FIG. 22(A)
Figure 23B:
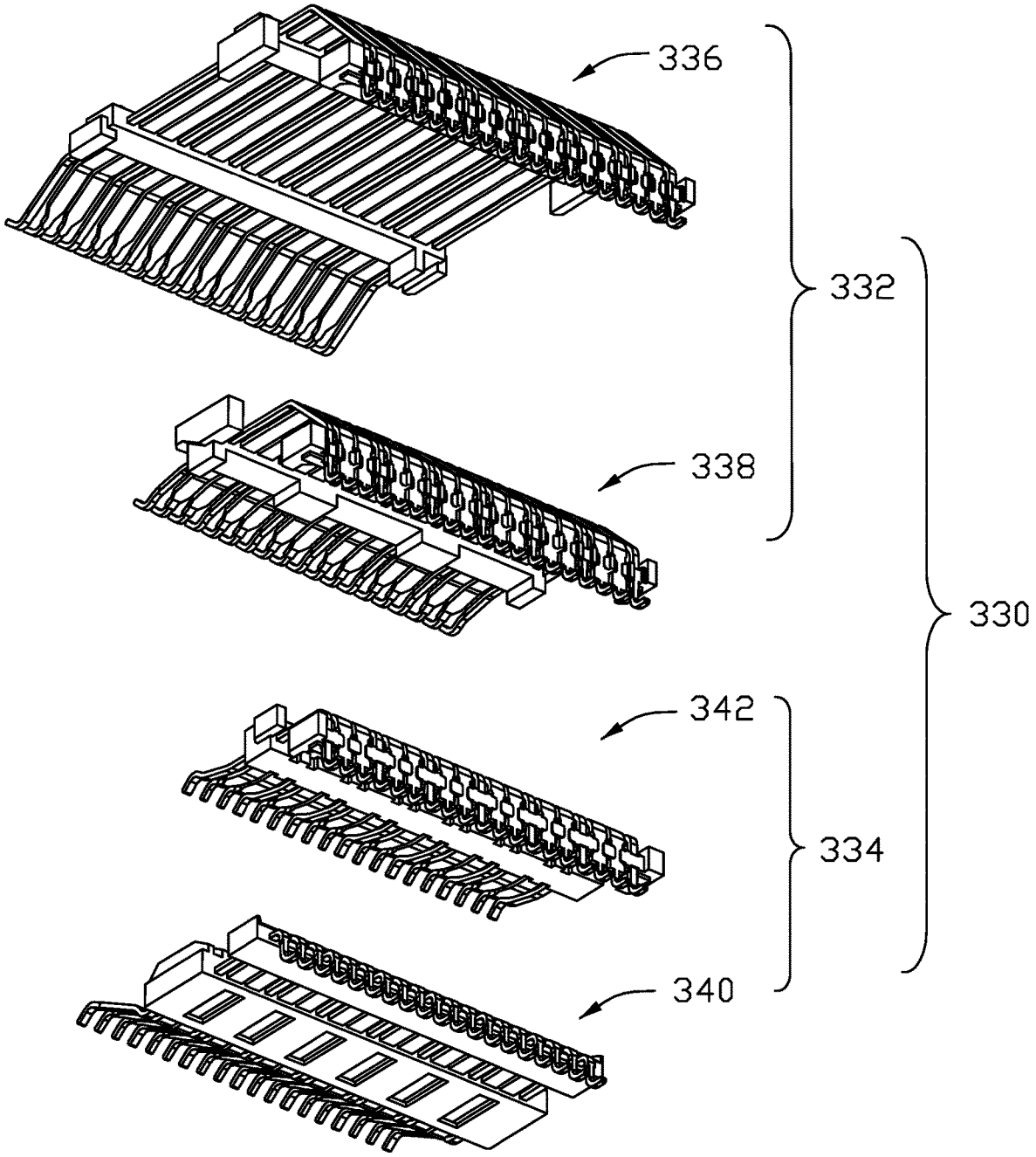
FIG. 23(B) is another exploded perspective view of the contact module of the lower connector unit of the electrical connector assembly of the electrical device of FIG. 23(A)
Figure 24:
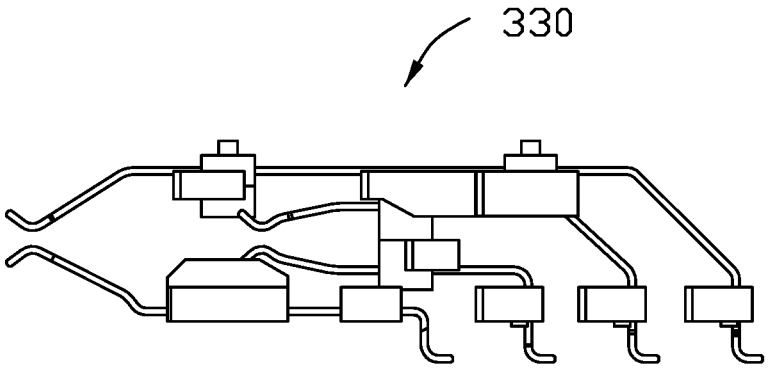
FIG. 24 is a side view of the contact module of the lower connector unit of the electrical connector assembly of the electrical device of FIG. 21(A).

Notably, similar to the upper front/outer contact part 136, the upper rear/inner contact part 138, the lower front/outer contact part 140 and the lower rear/inner contact part 142 are also equipped with the contacts and the insulative transverse bars, the metal grounding bars and the plastic attachment tie bars. As shown in FIG. 6, each contact part has a metal grounding bar at a rear end region of the horizontal sections of the retaining sections of the contacts, and another grounding bar at a rear end region of the oblique sections of the retaining sections of the contacts. A cover 190 is assembled upon the upper contact unit 132 wherein a plurality of positioning posts 173 are formed on the insulative transverse bar 160 so as to be received within the corresponding holes 191 of the cover 190. Each side wall 112 forms a plurality of horizontal grooves 113 so as to allow opposite ends of the corresponding insulative transverse bars to forwardly move therealong for assembling the contact module 130 and the associated cover 190 into the upper housing 110. After assembled, the front mating sections 148 of the contacts are respectively received within the corresponding passageways 124, respectively, and further extending into the mating slot 122.

Similar to the upper connector unit 100, the lower connector unit 300 includes an insulative lower housing 310 with a contact module 330 therein. The contact module 330 includes an upper contact unit 332 and a lower contact unit 334. The upper contact unit 332 includes an upper front/outer contact part 336 and an upper rear/inner contact part 338. The lower contact unit 334 includes a lower front/outer contact part 340 and a lower rear/inner contacts part 342. Each contact part 336, 338, 340, 342 includes a plurality of grounding contacts and a plurality of differential pair signal contacts alternately arranged with each other in the transverse direction. A cover 390 is assembled upon the upper front/outer contact part 336 of the upper contact unit 332. The contact module 330 associated with the cover 390 is commonly assembled into the lower housing 310.

In this embodiment, as shown in FIGS. 8(A)-10(B), the pair of side walls 112 of the upper housing 110 forms a pair of mounting legs 115 to be received within the corresponding vertical slots 312 in the pair of side walls 311 of the lower housing 310 so as to have the upper connector unit 100 downwardly assembled upon the lower connector unit 300 in the vertical direction.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A connector unit comprising:

an insulative housing forming a pair of vertical side walls opposite to each other in a transverse direction, and a vertical front wall extending in said transverse direction and defining a horizontal mating slot, the pair of side walls forming a plurality of horizontal grooves extending along a front-to-back direction perpendicular to the transverse direction;

a contact module received within the housing and comprising an upper contact unit and a lower contact unit stacked together in a vertical direction perpendicular to both the transverse direction and the front-to-back direction, said upper contact unit comprising an upper front/outer contact part and an upper rear/inner contact part, said lower contact unit comprising a lower front/outer contact part and a lower rear/inner contact part, each of said upper front/outer contact part, said upper rear/inner contact part, said lower front/outer contact part and said lower rear/inner contact part comprising a plurality of contacts integrally formed with a plurality of insulative transverse bars via insert-molding, said contacts comprising a plurality of differential pair signal contacts and a plurality of grounding contacts alternately arranged with each other in the transverse direction; wherein the insulative transverse bar of the upper front/outer contact part is equipped with a metallic grounding bar having a plurality of tabs mechanically and electrically connecting to corresponding grounding contacts thereof.

2. The connector unit as claimed in claim 1, wherein each of said upper front/outer contact part, said upper rear/inner contact part, said lower front/outer contact part and said lower rear/inner contact part comprising a plastic attachment tie bar is attached upon the metallic grounding bar so as to cooperate with the corresponding insulative transverse bar to sandwich the metallic grounding bar therebetween.

3. The connector unit as claimed in claim 1, wherein the insulative transverse bar of the upper rear/inner contact part is equipped with a metallic grounding bar having a plurality of tabs mechanically and electrically connecting to the corresponding grounding contacts thereof.

4. The connector unit as claimed in claim 1, wherein the insulative transverse bar of the lower front/outer contact part is equipped with a metallic grounding bar having a plurality of tabs mechanically and electrically connecting to the corresponding grounding contacts thereof.

5. The connector unit as claimed in claim 1, wherein the insulative transverse bar of the lower rear/inner contact part is equipped with a metallic grounding bar having a plurality of tabs mechanically and electrically connecting to the corresponding grounding contacts thereof.

6. The connector unit as claimed in claim 1, wherein opposite ends of the insulative transverse bars are engaged within the corresponding grooves to forwardly assemble the contact module into the housing along the front-to-back direction.

7. An electrical connector comprising:

an insulative housing defining a horizontal mating slot for receiving a mating plug;

a first contact module received within the housing and comprising a first pair of grounding contacts, a first pair of signal contacts disposed between the first pair of grounding contacts for transmitting a differential signal, a first insulative member molded with the first pair of grounding contacts and the first pair of signal contacts, and a first metallic grounding bar fixed by the first insulative member, the first metallic grounding bar electrically connected with the first pair of grounding contacts, but not electrically connected with the first pair of signal contacts; and a second contact module received within the housing and disposed opposite to the first contact module.

8. The electrical connector as claimed in claim 7, wherein the first metallic grounding bar comprises a first base portion and a first pair of tabs extending away from the first base portion to electrically connected with the first pair of grounding contacts respectively, the first base portion spaced apart from the first pair of the signal contacts to isolate with the first pair of signal contacts.

9. The electrical connector as claimed in claim 8, wherein each of the first pair of grounding contacts defines a first slit, the first tab extending through the first slit to electrically connect with the first grounding contact.

10. The electrical connector as claimed in claim 8, wherein the first tabs are stamped from the first base portion.

11. The electrical connector as claimed in claim 7, wherein the first metallic grounding bar comprises a plurality of first holes, and the first insulative member comprises a plurality of first positing posts extending through the first holes, respectively.

12. The electrical connector as claimed in claim 11, wherein the first contact module comprises a first conductive plastic tie bar assembled upon the first metallic grounding bar.

13. The electrical connector as claimed in claim 12, wherein the first conductive plastic tie bar is press fitted with the first positing posts of the first insulative member.

14. The electrical connector as claimed in claim 12, wherein the first conductive plastic tie bar is ultrasonic welding with the first insulative member.

15. The electrical connector as claimed in claim 7, wherein the second contact module comprises a second pair of grounding contacts, a second pair of signal contacts disposed between the second pair of grounding contacts for transmitting a differential signal, a second insulative member molded with the second pair of grounding contacts and the second pair of signal contacts, and a second metallic grounding bar fixed by the second insulative member, the second metallic grounding bar electrically connected with the second pair of grounding contacts, but not electrically connected with the second pair of signal contacts.

16. An electrical connector assembly comprising:

a lower connector unit comprising:

a lower insulative housing forming a pair of lower vertical side walls opposite to each other in a transverse direction, and a lower vertical front wall extending in said transverse direction and defining a lower horizontal mating slot; and a lower contact module received within the lower housing and comprising an lower contact unit comprising a plurality of lower contact parts stacked together in a vertical direction perpendicular to both the transverse direction and a front-to-back direction, each of said lower contact parts comprising a plurality of lower contacts integrally formed with a plurality of lower insulative bars via insert-molding, said lower contacts comprising a pair of lower grounding contacts and a pair of lower differential pair signal contacts disposed therebetween in the transverse direction, each of the lower insulative bar equipped with a lower metallic grounding bar having a plurality of lower tabs mechanically and electrically connecting to the corresponding lower grounding contacts thereof; and an upper connector unit comprising:

an upper insulative housing stacked with the lower insulative housing in the vertical direction, the upper insulative housing forming a pair of upper vertical side walls opposite to each other in the transverse direction, and an upper vertical front wall extending in said transverse direction and defining an upper horizontal mating slot; and an upper contact module received within the upper housing and comprising an upper contact unit comprising a plurality of upper contact parts stacked together in the vertical direction, each of said upper contact parts comprising a plurality of upper contacts integrally formed with a plurality of upper insulative bars via insert-molding, said upper contacts comprising a pair of upper grounding contacts and a pair of upper differential pair upper signal contacts disposed therebetween in the transverse direction, each of the upper insulative bar equipped with an upper metallic grounding bar having a plurality of upper tabs mechanically and electrically connecting to the corresponding upper grounding contacts thereof.

17. The electrical connector assembly as claimed in claim 16, wherein the lower contact module part comprises a plurality of lower plastic conductive bars attached upon the lower metallic grounding bars so as to cooperate with the corresponding lower insulative bar to sandwich the lower metallic grounding bar therebetween, and the upper contact module part comprises a plurality of upper plastic conductive bars attached upon the upper metallic grounding bars so as to cooperate with the corresponding upper insulative bar to sandwich the upper metallic grounding bar therebetween.

18. The electrical connector assembly as claimed in claim 16, wherein each of the lower plastic conductive bars is ultrasonic welding with the lower insulative bar respectively, and the each of the upper plastic conductive bars is ultrasonic welding with the upper insulative bar respectively.

19. The electrical connector assembly as claimed in claim 16, wherein each of the upper grounding contacts defines an upper slit, the upper tabs press fitted into the upper slits respectively, and each of the lower grounding contacts defines a lower slit, the lower tabs press fitted into the lower slits respectively.

20. The electrical connector assembly as claimed in claim 16, wherein the lower insulative housing defines slots, and the upper insulative housing comprises mounting legs assembled with the slots, respectively.

* * * * *